US007189500B2

(12) United States Patent
Tsukada et al.

(10) Patent No.: US 7,189,500 B2
(45) Date of Patent: Mar. 13, 2007

(54) PHOTOTHERMOGRAPHIC IMAGE-RECORDING MATERIAL

(75) Inventors: Yoshihisa Tsukada, Minami Ashigara (JP); Hajime Nakagawa, Minami Ashigara (JP); Seiji Hatano, Minami Ashigara (JP); Tomokazu Yasuda, Minami Ashigara (JP)

(73) Assignee: Fuji Photo Film Co., Ltd., Minami Ashigara (JP)

( * ) Notice: Subject to any disclaimer, the term of this patent is extended or adjusted under 35 U.S.C. 154(b) by 0 days.

(21) Appl. No.: 09/953,958

(22) Filed: Sep. 18, 2001

(65) Prior Publication Data

US 2002/0058220 A1 May 16, 2002

(30) Foreign Application Priority Data

Sep. 18, 2000 (JP) ..... P.2000-281809

(51) Int. Cl.
*G03C 1/498* (2006.01)
*G03C 1/74* (2006.01)

(52) U.S. Cl. ..... 430/531; 430/539; 430/619

(58) Field of Classification Search ..... 430/536, 430/531, 619, 529, 935
See application file for complete search history.

(56) References Cited

U.S. PATENT DOCUMENTS

| | | | | | |
|---|---|---|---|---|---|
| 4,411,985 | A | * | 10/1983 | Morrow et al. | 430/352 |
| H001578 | H | * | 8/1996 | Taguchi | 430/523 |
| 6,013,410 | A | * | 1/2000 | Arai | 430/264 |
| 6,132,948 | A | | 10/2000 | Hatakeyama | |
| 6,258,524 | B1 | * | 7/2001 | Hirabayashi et al. | 430/619 |
| 6,312,885 | B1 | * | 11/2001 | Fujita et al. | 430/617 |
| 6,333,147 | B1 | * | 12/2001 | Toya | 430/619 |
| 6,461,805 | B1 | * | 10/2002 | Habu et al. | 430/619 |

FOREIGN PATENT DOCUMENTS

EP 0 803 764 A1 10/1997

* cited by examiner

*Primary Examiner*—Thorl Chea
(74) *Attorney, Agent, or Firm*—Birch, Stewart, Kolasch & Birch, LLP

(57) ABSTRACT

A photothermographic image-recording material with improved storability before image formation and improved coating characteristics, which has a support having provided thereon an image-forming layer, the layer having at least one light-insensitive organic silver salt, a reducing agent for silver ion and a binder, wherein the binder has a polymer having a recurring unit represented by the formula (1), and the content of the recurring unit represented by the formula (1) in the polymer is from 0.1 to 50% by weight.

10 Claims, No Drawings

PHOTOTHERMOGRAPHIC IMAGE-RECORDING MATERIAL

FIELD OF THE INVENTION

The present invention relates to photothermographic image-recording materials. More particularly, the invention relates to photothermographic image-recording materials that have an improved coated surface structure and improved storability former to image formation. More specifically, the invention relates to photothermographic image-recording materials that are improved in the coated surface structure and in the storability former to image formation by using a polymer having a strongly acid dissociable group or a hydrophilic nonionic group as the binder.

BACKGROUND OF THE INVENTION

Recently, in the medical field, it is earnestly demanded to reduce the volume of the processing solution waste from the viewpoints of environment conservation and space saving. To achieve such a demand, technologies are necessary that can produce photothermographic image-recording materials used for medical diagnosis and photographic application, which materials can be efficiently exposed with laser image-setters or laser imagers to form crisp black images of high resolution as well as superior sharpness. Such photothermographic image-recording materials eliminate the use of solution type processing chemicals and therefore can provide customers with heat development systems which are simple and environmentally friendly.

Although similar requirements exist even in the field of general image formation, it is characterized that medical images must have a high image quality inclusive of excellent sharpness and excellent granularity as fine descriptions are required, and are expected to look blue black for the ease of diagnosis. At present, there is no medical image output system that satisfies the above requirements, though a variety of hardcopy output systems are in practical use for general image formation including inkjet and electrophotographic printers which form images made of pigments or dyes.

On the other hand, heat-developable image-forming systems which use organic silver salts are known as are described in, for example, U.S. Pat. Nos. 3,152,904 and 3,457,075, p. 279, Chapter 9 of "Thermally Processed Silver Systems" written by D. Klosterboer and "Imaging Processes and Materials, Neblette's 8th edition", edited by J. Sturge, V. Walworth and A. Shepp (1989). Generally, a photothermographic image-recording material has a photosensitive layer comprising a photo catalyst exemplified by silver halide in a catalytic activity quantity, a reducing agent, a reducible silver salt such as organic silver salt and, if needed, an agent for controlling the tone of the developed silver, all dispersed in a matrix of a binder. Such a photothermographic image-recording material that has been subjected to an image exposure is heated to an elevated temperature (e.g., 80° C.), causing a redox reaction between the silver halide or the reducible silver salt (acting as an oxidant) and the reducing agent to give rise to a black image made of silver. The redox reaction is promoted by the catalytic action of the latent image in the silver halide formed by the exposed light. Accordingly, a black silver image is formed at an exposed area. Photothermographic image-recording materials and systems based on the principle explained above are disclosed in many references such as U.S. Pat. No. 2,910,377 and JP-B-43-4924 (The term "JP-B" as used herein means an "examined Japanese patent publication"). A commercially available example of medical image forming systems based on such photothermographic image-recording material is given by Fuji Medical Dry Imager FM-DP L.

A photothermographic image-recording material is known in which an image-forming layer is provided by coating and drying an organic solvent-based coating solution as disclosed in U.S. Pat. No. 5,415,993. Further, for environment conservation and a higher safety, various technologies enabling the formation of the image-recording layer using aqueous solvents instead of organic solvents are proposed in, e.g., JP-A-10-10670 and JP-A-10-186565 (The term "JP-A" as used herein means an "unexamined published Japanese patent application") . However, in the methods as described in these patents, in spite of the advantages on environment conservation and safety, the aqueous coating solutions must be kept at a pH not lower than 8 to secure a desirable coating property, as the acid coating solution for the image forming layer suffers from an undesirable viscosity increase and coagulation caused by the interaction of the binder polymer with the solid dispersions that are needed for photothermographic image-recording material. On the other hand, it is well known that the silver halide photographic emulsion in an alkaline pH environment tends to increase fog of photosensitive material prior to image formation because it becomes the reducing atmosphere. Hence, there is a problem of storing the photosensitive material prior to image formation. With such a problem in the prior art technologies, polymer materials that can impart both a good storability of image of photosensitive material prior to image formation and a desirable coating property have been urgently demanded as a binder for the image forming layer.

SUMMARY OF THE INVENTION

The problem that the invention tries to solve is to provide photothermographic image-recording materials with a good storability former to image forming and a good coating property.

In order to solve the above-cited problem, the inventors have extensively investigated the binder for photothermographic image-recording materials, and found that the introduction of a strongly acid dissociable group or a hydrophilic nonionic group in the binder polymer can improve the storability former to image forming and the coating property as the resulting polymer can lower the pH of the coating solution for the image-forming layer. The invention is based on this finding.

According to the invention, a photothermographic o image-recording material is provided which comprises a support having provided thereon an image-forming layer, the layer comprising at least one photo-insensitive organic silver salt, a reducing agent for silver ion and a binder, characterized by that the binder comprises a polymer having a recurring unit represented by the following formula (1), and that the content of the recurring unit represented by the formula (1) in the polymer is from 0.1 to 50% by weight.

(1)

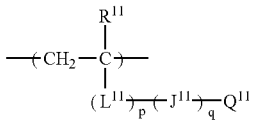

In formula (1), $R^{11}$ represents hydrogen, an alkyl group, a halogen atom, or —$CH_2COOM^1$, and $L^{11}$ represents —CONH—, —NHCO—, —COO—, —OCO—, —CO— or —O—. $J^{11}$ represents an alkylene group, an arylene group, an aralkylene group or a connecting group represented by the following formula (2).

$$-(CH_2CH_2O)_m-(CH_2)_n- \quad (2)$$

In formula (2), m represents an integer of 1 to 120 and n represents an integer of 0 to 6.

In formula (1), $Q^{11}$ represents —$SO_3M^2$ or —O—P(O)—$(OM^3)_2$ when $J^{11}$ represents an alkylene group, an arylene group or an aralkylene group, and $Q^{11}$ represents —$SO_3M^2$, —O—P(O)—$(OM^3)_2$ or hydrogen when $J^{11}$ represents the connecting group represented by formula (2).

$M^1$, $M^2$ and $M^3$ each represents independently hydrogen or a mono-valent cation.

In formula (1), p and q each represents independently 0 or 1.

Preferably, the glass transition temperature of the binder described above is in the range of from −20 to 80° C.

Preferably, the binder described above is a latex produced by emulsion polymerization.

Preferably, the binder described above is a copolymer comprising, in addition to the recurring unit represented by formula (1) , a conjugated diene or an α,β-unsaturated carboxylic acid derivative as a monomer. Particularly preferably, the binder described above is a copolymer comprising, in addition to the recurring unit represented by formula (1), a conjugated diene as a monomer.

Preferably, the pH of the coating composition for the image-forming layer described above is from 3.0 to 8.0.

Preferably, the image-forming layer described above comprises at least one photosensitive silver halide.

DETAILED DESCRIPTION OF THE INVENTION

In the following, some practical embodiments and practicing methods of the invention will be explained in detail.

First of all, the polymers having a recurring unit represented by formula (1) will be described in detail.

In formula (1), $R^{11}$ represents hydrogen, an alkyl group, a halogen atom (F, Cl, Br or I) or —$CH_2COOM^1$, preferably hydrogen, a $C_{1-6}$ alkyl group, chlorine atom or —$CH_2COOM^1$, more preferably hydrogen, a $C_{1-4}$ alkyl group or —$CH_2COOM^1$ (wherein $M^1$ represents hydrogen or a mono-valent cation) , and particularly preferably hydrogen or a $C_{1-2}$ alkyl group. The specific examples of the alkyl group include methyl, ethyl, n-propyl, iso-propyl, n-butyl and sec-butyl. These alkyl groups may have a substitutent such as halogen, an aryl group, a hetercyclic group, an alkoxy group, an aryloxy group, an alkylthio group, an arylthio group, a hydroxyl group, an acyloxy group, an amino group, an alkoxycarbonyl group, an acyl group, an acyamino group, an oxycarbonyl group, a carbamoyl group, a sulfonyl group, a sulfamoyl group, a sufonamido group, a phosphoryl group and a carboxyl group.

In formula (1), $L^{11}$ represents *—CONH—, *—NHCO—, *—COO—, *—OCO—, —CO— or —O—, preferably *—CONH—, *—NHCO—, *—COO—, *—OCO— or —CO—, more preferably *—CONH—, *—NHCO—, *—COO— or *—OCO—, and particularly preferably *—CONH— or *—COO—. In the expression, * designates the direction to the main chain.

In formula (1), $J^{11}$ represents an alkylene group, an arylene group, an aralkylene group or a connecting group represented by formula (2). The alkylene group preferably contains 1 to 10, more preferably 1 to 8, and particularly preferably 1 to 6 carbon atoms, exemplified by methylene, ethylene, propylene, butylene and hexylene. Such a alkylene group may have an appropriate substituent. Preferable substituents include the groups mentioned as the preferable substituent for the alkyl group represented by $R^{11}$. The arylene group preferably contains 6 to 24, more preferably 6 to 18, and particularly preferably 6 to 12 carbon atoms, exemplified by phenylene and naphthalene. Preferable aralkylene groups include those comprising the above-mentioned alkylene group connected to the above-mentioned arylene group. These groups may have an appropriate substituent. Preferable substituents include the groups enumerated above as the preferable substituent for the alkyl group represented by $R^{11}$.

In formula (2), m represents an integer of 1 to 120, and n represents an integer of 0 to 6, but preferably m represents an integer of 1 to 90 and n represents an integer of 0 to 5. Particularly preferably, m represents an integer of 1 to 40, and n represents an integer of 0 to 4.

In formula (1), when $J^{11}$ represents an alkylene group, an arylene group or an aralkylene group, $Q^{11}$ represents —$SO^3M^2$ or —O—P(O)—$(OM^3)_2$, and when $J^{11}$ represents a connecting group represented by formula (2), $Q^{11}$ represents —$SO_3M^2$, —O—P(O)—$(OM^3)_2$ or hydrogen. When $J^{11}$ represents an alkylene group, an arylene group or an aralkylene group, $Q^{11}$ preferably represents —$SO_3M^2$, and when $J^{11}$ represents a connecting group represented by formula (2), $Q^{11}$ preferably represents —$SO_3M^2$ or hydrogen.

$M^1$, $M^2$ and $M^3$ each represents independently hydrogen or a mono-valent cation, and the two $M^3$'s present in a single molecule may be the same or different. The mono-valent cation represented by $M^1$, $M^2$ or $M^3$ is potassium ion, sodium ion or lithium ion, among which potassium ion or sodium ion is preferred.

In formula (1), p and q each represents independently 0 or 1.

Next, some specific examples of the recurring unit represented by formula (1) will be listed.

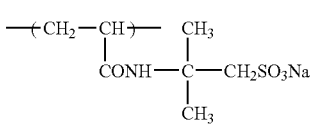
(1-1)

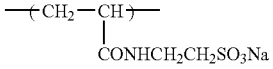
(1-2)

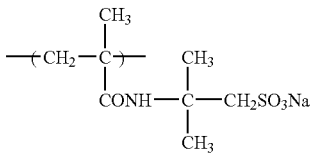
(1-3)

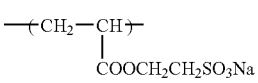
(1-4)

-continued
(1-5)
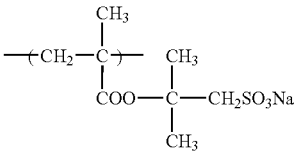
(1-6)
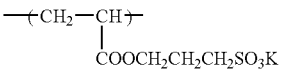
(1-7)
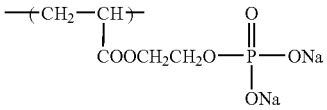
(1-8)
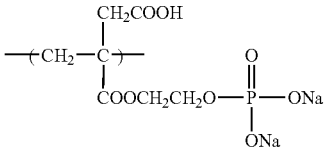
(1-9)
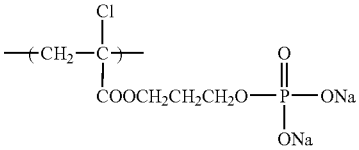
(1-10)
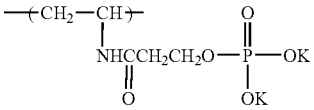
(1-11)
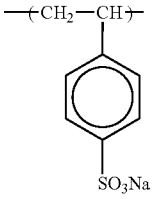
(1-12)
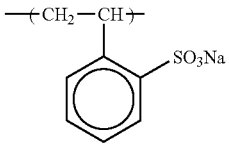
(1-13)
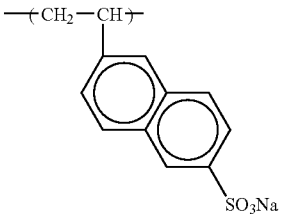
(1-14)
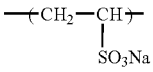
(1-15)
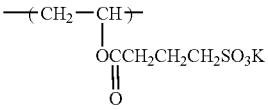
-continued
(1-16)
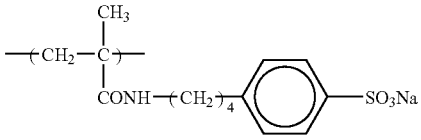
(1-17)
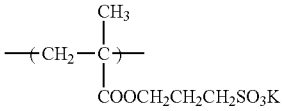
(1-18)
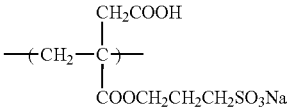
(1-19)
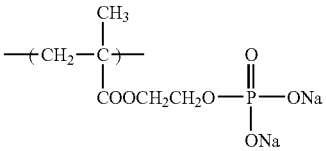
(1-20)
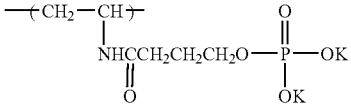
(1-21)
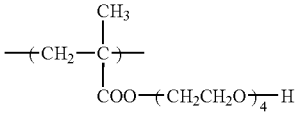
(1-22)
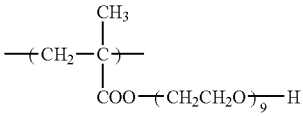
(1-23)
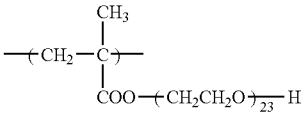
(1-24)
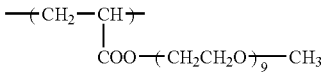
(1-25)
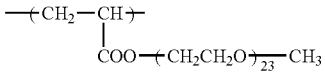
(1-26)
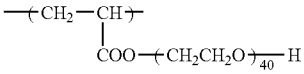
(1-27)
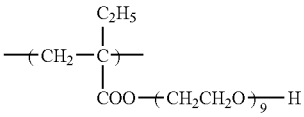
(1-28)
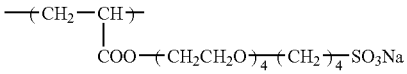

-continued (1-29)

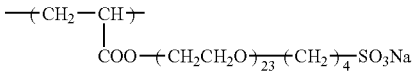

(1-30)

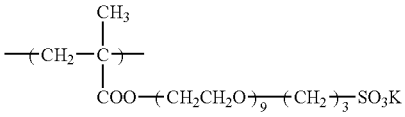

(1-31)

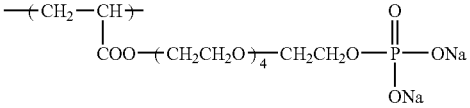

(1-32)

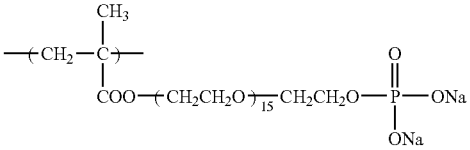

(1-33)

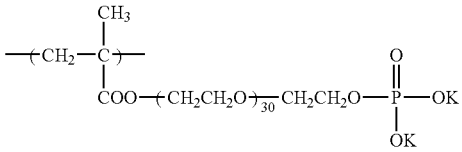

(1-34)

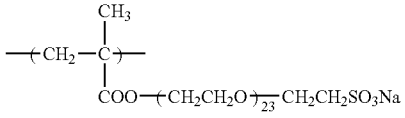

Any polymer can be used as the binder for the photothermographic image-recording material of the invention provided that it comprises the recurring unit represented by formula (1) . Thus, polymers comprising various resins such an acrylic resin, a polyester resin, a rubber-based resin (e.g., conjugated diene copolymers), a polyurethane resin, a vinyl chloride resin, a vinyl acetate resin, a vinylidene chloride resin or a polyolefin resin copolymerized with a recurring unit monomer represented by formula (1). Among them, preferable materials include an acrylic resin, a polyester resin, a rubber-based resin (e.g., conjugated diene copolymers) and a polyurethane resin, and particularly preferable ones include an acrylic resin or a rubber-based resin (e.g., conjugated diene copolymers).

The binder used in the invention can preferably be selected from homopolymers and copolymers obtained by independently and arbitrarily combining monomers listed below in addition to the recurring unit represented by formula (1). Among such polymers, conjugated diene copolymers are particularly preferred. There is no special limitation on the monomer unit to be used so long as the unit is polymerizable by ordinary radical or ionic polymerization.

Monomers:

(a) Conjugated dienes: e.g., 1,3-butadiene, isoprene, 1,3-pentadiene, 2-ethyl-1,3-butadiene, 2-n-propyl-1,3-butadiene, 2,3-dimethyl-1,3-butadiene, 2-methyl-1,3-butadiene, 1-phenyl-1,3-butadiene, 1-α-naphthyl-1,3-butadiene, 1-β-naphthyl-1,3-butadiene, 2-chloro-1,3-btadiene, 1-bromo-1,3-butadiene, 1-chloro-1,3-butadiene, 2-fluoro-1,3-butadiene, 2,3-dichloro-1,3-butadiene, 1,1,2-trichloro-1,3-butadiene, 2-cyano-1,3-butadiene and cyclopentadiene.

(b) Olefins: e.g., ethylene, propylene, vinyl chloride, vinylidene chloride, 6-hydroxy-1-hexene, 4-pentenoic acid, methyl 8-nonenoate, vinylsulfonic acid, trimetylvinylsilane, trimethoxyvinylsilane, 1,4-divinylcyclohexane and 1,2,5-trivinylcyclohexane.

(c) α,β-Unsaturated carboxylic acids and their salts: e.g., acrylic acid, methacrylic acid, itaconic acid, maleic acid, sodium acrylate, ammonium methacrylate and potassium itaconate.

(d) Derivatives of α,β-unsaturated carboxylic acid: e.g., alkyl acrylate (e.g., methyl, ethyl, butyl, cyclohexyl, 2-ethylhexyl, or dodecyl acrylate), substituted alkyl acrylate (e.g., 2-chloroethyl, benzyl or 2-cyanoethyl acrylate), alkyl methacrylate (e.g., methyl, butyl, 2-ethylhexyl or dodecyl methacrylate), substituted alkyl methacrylate (e.g., 2-hydroxyethyl or glycidyl methacrylate, glycerin monomethacrylate, 2-acetoxyethyl, tetrahydrofurfuryl or 2-methoxyethyl methacrylate, polypropylene glycol monomethacrylate (added mole number of polyoxypropylene=2 to 100), 3-N,N-dimethylamonopropyl, chloro-3-N,N,N-trimethylammoniopropyl, 2-carboxyethyl, 3-sulfopropyl, 4-oxysulfobutyl, 3-trimethoxysilylpropyl, allyl or 2-isocyanatoethyl methacrylate), derivatives of unsaturated dicarboxylic acid (e.g., monobutyl or dimethyl maleate, monomethyl or dibutyl itaconate), polyfunctional esters (e.g., ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate or 1,2,4-cyclohexane tetramethacrylate).

(e) Amides of β-unsaturated carboxylic acids: e.g., acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl)acrylamide, N-acryloylmorpholine, diacetoneacrylamide, itaconic acid diamide, N-methylmaleimide, 2-acrylamidemethylpropanesulfonic acid, methylnebisacryl-amide or dimethacryloylpyperadine.

(f) Unsaturated nitriles: e.g., acrylonitrile or methacrylonitrile.

(g) Styrene and its derivatives: e.g., styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene or 1,4-divinylbenzene.

(h) Vinyl ethers: e.g., methyl vinyl ether, butyl vinyl ether or methoxyethyl vinyl ether.

(i) Vinyl esters: e.g., vinyl acetate, vinyl propionate, vinyl benzoate, vinyl salicylate or vinyl chloroacetate.

(j) Other polymerizable monomers: e.g., N-vinylimidazole, 4-vinylpyridine, N-vinylpyrrolidone, 2-vinyloxazoline, 2-isopropenyloxazoline or divinylsulfone.

Preferable copolymerization components for conjugated diene copolymers include styrene-butadiene copolymers (e.g., buadiene-styrene or styrene-butadiene-styrene block copolymers), styrene-isoprene copolymers including random and block ones, ethylene-propylene-diene copolymers in which the diene monomer is chosen from 1,4-hexadiene, dicyclopentadiene or ethylydenenorbornene, acrylonitrile-butadiene copolymers, isobutylene-isoprene copolymers, butadiene-acrylic acid ester copolymers in which the ester is chosen from ethyl or butyl acrylate and butadiene-acrylic acid ester-acrylonitrile copolymers in which the ester is chosen from ethyl or butyl acrylate.

Preferable examples for the copolymerization components of such α,β-unsaturated carboxylic acid derivative copolymers include styrene-alkyl acrylate, styrene-substituted alkyl acrylate, styrene-alkyl methacrylate, styrene-substituted alkyl methacrylate, or styrene-α,β-unsaturated dicarboxylic acid derivative copolymers.

The content of the recurring unit represented by formula (1) in the binder polymer of the invention is preferably from 0.1 to 50, more preferably from 0.2 to 30, and particularly preferably from 0.5 to 20% by weight.

The binder polymer used in the invention has a glass transition temperature (Tg) ranging preferably from −20 to 80, more preferably from 0 to 70, and still more preferably from 10 to 60° C. from the viewpoints of film-forming capability and image storability. As the binder, two or more kinds of polymers can be blended, whereby the Tg derived by weight-averaging the Tg's of all the ingredients is in the range described above. When such a polymer blend causes phase separation or has a core-shell structure, it is desirable that each phase has a Tg fallen within the above-described range.

Some specific examples of the polymers containing the recurring unit represented by formula (1) and used in the invention will be listed below. In the list, molecular weight is expressed in terms of number-averaged one, but is not shown for the polymers based on a polyfunctional monomer as the concept of molecular weight is not applicable to such polymers. Each of the notations, x, y, z and z' written along the polymer main chain of chemical formula indicates the weight ratio of each polymer, thus x, y, z and z' sums up to 100%. The numeral at the bottom right to the parenthesis attached to the polymer side chain indicates the degree of polymerization. Tg indicates glass transition temperature.

(P-1)

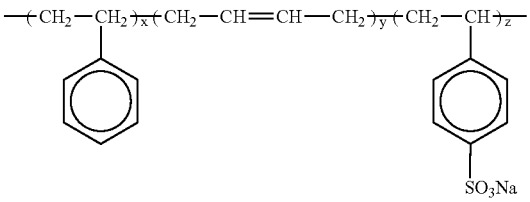

x = 70
y = 29
z = 1

Molecular weight: -
Tg = 19° C.

(P-2)

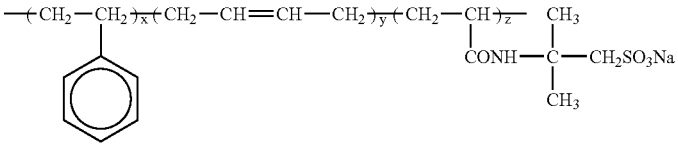

x = 68
y = 29
z = 3

Molecular weight: -
Tg = 21° C.

(P-3)

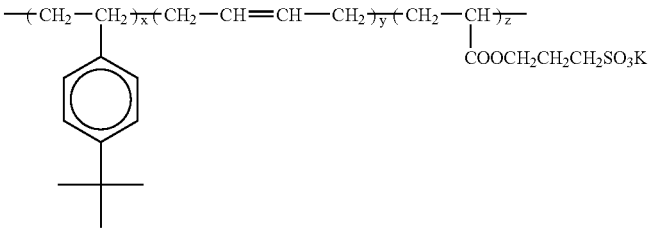

x = 60
y = 35
z = 3

Molecular weight: -
Tg = 40° C.

(P-4)

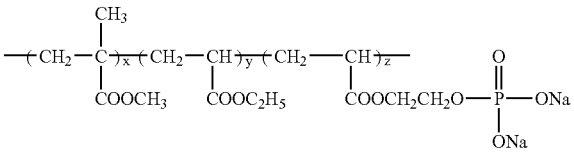

x = 70
y = 27
z = 3

Molecular weight: 83,000
Tg = 65° C.

(P-5)

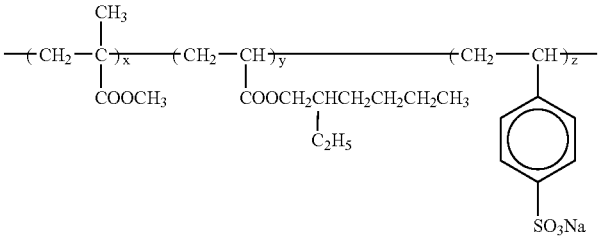

x = 55
y = 35
z = 10

Molecular weight: 95,000
Tg = 38° C.

-continued
(P-6)
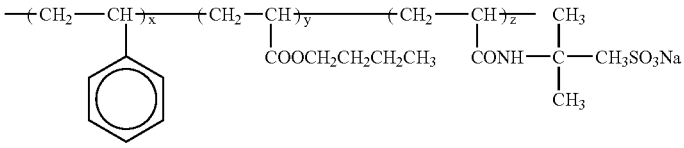
x = 59
y = 40.5
z = 0.5
Molecular weight: 100,000
Tg = 18° C.
(P-7)
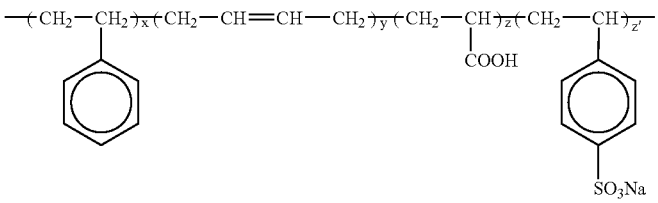
x = 70
y = 27
z = 1
z′ = 2
Molecular weight: -
Tg = 24° C.
(P-8)
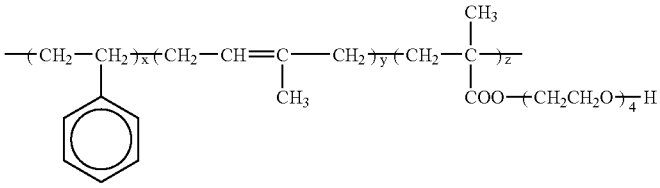
x = 75
y = 5
z = 20
Molecular weight: -
Tg = 38° C.
(P-9)
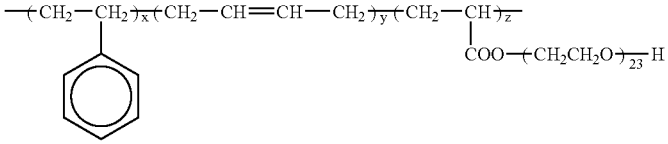
x = 70
y = 15
z = 15
Molecular weight: -
Tg = 22° C.
(P-10)
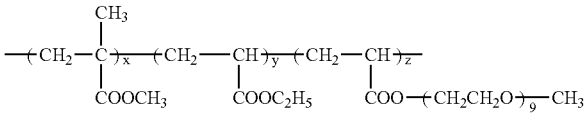
x = 45
y = 45
z = 10
Molecular weight: - 120,000
Tg = 14° C.
(P-11)
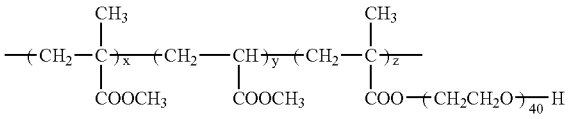
x = 15
y = 80
z = 5
Molecular weight: - 98,000
Tg = 16° C.
(P-12)
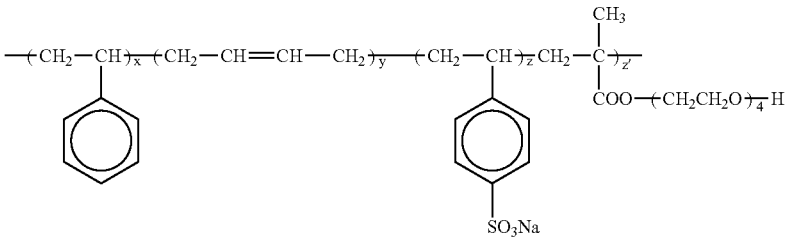
x = 60
y = 35
z = 3
z′ = 2
Molecular weight: -
Tg = 3° C.
(P-13)
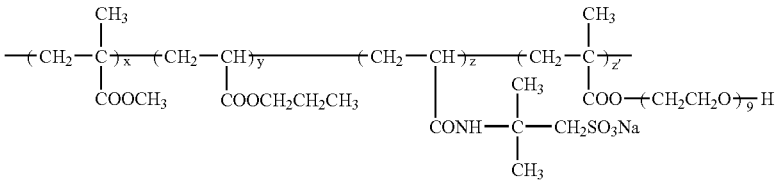
x = 30
y = 60
z = 0.1
z′ = 9.9
Molecular weight: 74,000
Tg = -10° C.

-continued (P-14)

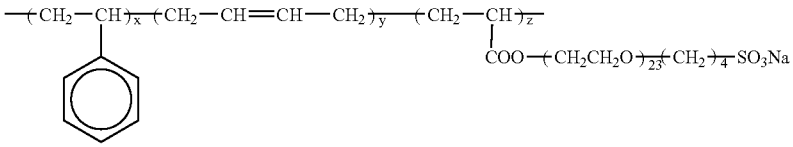

x = 55
y = 40
z = 5

Molecular weight: -
Tg = -5° C.

(P-15)

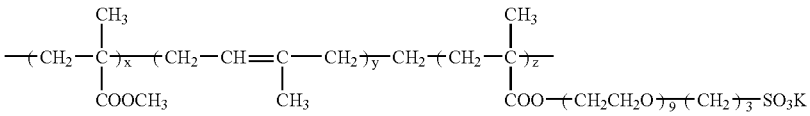

x = 60
y = 33
z = 7

Molecular weight: -
Tg = 7° C.

(P-16)

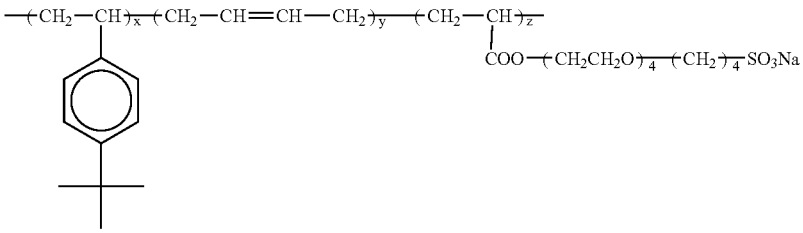

x = 62
y = 35
z = 3

Molecular weight: -
Tg = 12° C.

(P-17)

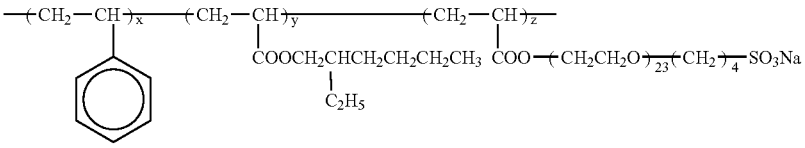

x = 50
y = 45
z = 5

Molecular weight: 133,000
Tg = 10° C.

(P-18)

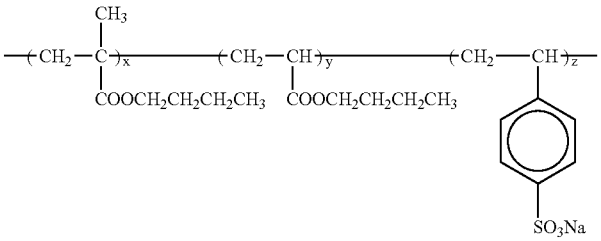

x = 40
y = 45
z = 15

Molecular weight: 180,000
Tg = -4° C.

(P-19)

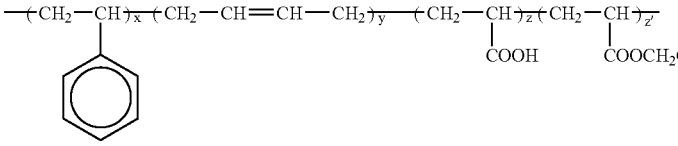

x = 64
y = 31
z = 1
z' = 4

Molecular weight: -
Tg = 15° C.

(P-20)

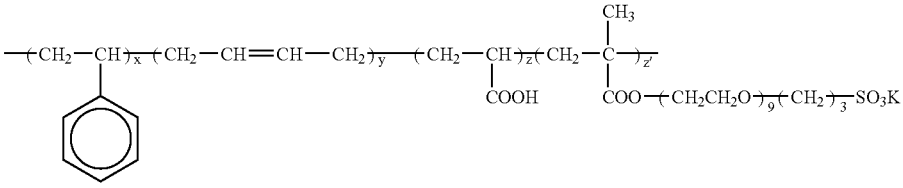

x = 65
y = 25
z = 2
z' = 8

Molecular weight: -
Tg = 23° C.

Each of these polymers may be used solely or in combination of two or more. Furthermore, those outside the scope of the invention may be used together with any of the polymers characterizing the invention enumerated above.

The polymer used in the invention can be prepared by any prepartion method inasmuch as it is applicable to the manufacture of photographic photosensitive materials. Examples of aqueous dispersions comprising fine polymer particles generally include polymer emulsions prepared by emulsifying a water-immiscible organic solvent (e.g., ethyl acetate or a perfluoroalkane) solution of a polymer into an aqueous medium with the aid of a surfactant or protective colloid, and polymer latices prepared directly by a polymerization reaction carried out in an aqueous medium.

Among these two types of dispersion, the latter process is particularly favorable for the present invention due to its capability of making the dispersed particles very fine, an excellent stability of the dispersion and the requirement of very small amount of surfactant.

The polymer used in the invention can be prepared by ordinary polymerization reactions including emulsion, dispersion and suspension polymerizations. However, most of the photographic photosensitive materials are produced via a coating procedure using an aqueous medium, wherein water-insoluble substances such as the aforementioned copolymer are conveniently incorporated in the form of water dispersion. Accordingly, the former two polymerization methods are suited for the invention in view of the preparation of coating solution, and in these two, emulsion polymerization is particularly preferred. When such a latex is used, the particle diameter not exceeding 500 nm is usually preferred. More preferably, dispersed particles with diameters not larger than 300 nm, and still more preferably those with diameters not larger than 200 nm are used.

Emulsion polymerization uses a dispersion medium comprising water or a mixture of water and a water-miscible organic solvent such as methanol, ethanol or acetone, in which a monomer mixture of 5 to 40% by weight of the medium, a polymerization initiator of 0.05 to 5% by weight of the monomer and an emulsifier of 0.1 to 20% by weight of the monomer are incorporated. The resulting mixture is stirred for 3 to 8 hours at 30 to 100° C., more preferably at 60 to 90° C., to cause the polymerization of the monomer. The reaction conditions including medium composition, monomer concentration, the quantity of the initiator as well as the emulsifier, reaction temperature and time and the method of monomer introduction are appropriately determined taking into consideration the type of the monomer used and the particle diameter to be achieved. In the production of HC/LC type latices used in the invention, a chain transfer agent is desirably used for the control of gelation ratio.

Preferable initiators used for emulsion polymerization include inorganic peroxides such as potassium or ammonium persulfate, azonitrile compounds such as sodium azobiscyanovalerate, azoamidine compounds such as 2,2'-azobis (2-amidinopropane) dihydrochloric acid salt, cyclic azoamidine compounds such as 2,2'-azobis[2-(5-methyl-2-imidazoline-2-yl)propane] hydrochloric acid salt and azoamidine compounds such as 2,2'-azobis {2-methyl-N-[1,1'-bis (hydroxymethyl)-2-hydroxyethyl]propionamide}. Among those potassium persulfate and ammonium persulfate are particularly preferred.

Suitable emulsifiers include anionic, nonionic, cationic and amphoteric surfactants, among which anionic ones are preferred.

The polymer used in the invention can be readily synthesized by the ordinary emulsion polymerization. As for the ordinary emulsion polymerization, reference can be made to the following books. *Gousei Jushi Emarujon* (*Synthetic Resin Emulsion*) edited by Taira Okuda and Hiroshi Inagaki in 1978, *Gousei Ratekkusu no Oyo* (*Applications of Synthetic Latices*), edited by Taka-aki Sugimura, Yasuo Kataoka, Souichi Suzuki, and Keiji Kasahara in 1993 and *Gousei Rattekusu No Kagaku* (*Chemistry of Synthetic Latices*), authored by Souichi Muroi in 1993, all published by Kobunshi Kankokai(Polymer Material Publishers).

The Tg of a polymer was calculated by the following equation.

$$1/Tg=\Sigma(Xi/Tgi)$$

In the equation, the polymer is assumed to be made of n kinds of monomers of from i=1 to i=n. Xi is the weight fraction of the ith monomer (thus, $\Sigma Xi=1$), and Tgi is the glass transition temperature in absolute scale of the homopolymer of the ith monomer. In the equation, the summation is made from i=1 to i=n. Here, the Tg value (Tgi) of the homopolymer of each monomer was taken from *Polymer Handbook, 3rd Edition,* authored by J. Brandrup and E. H. Immergut, published by Wiley-Interscience in 1989.

Hereinafter, a synthesis example of a polymer used in the invention will be described.

EXAMPLE OF SYNTHESIS

Synthesis of Exemplary Compound P-1

In a glass autoclave (TEM-V1000 made by Taiatsu Techno Corp.), 311 g distilled water, 1.6 g of a surfactant (Sandet BL made by Sanyo Chemical Industries, Ltd.), 105 g styrene, 1.5 g sodium p-styrenesulfonate, and 0.6 g tert-dodecylmercaptane were placed, and the content was stirred for one hour under nitrogen stream. Then, the autoclave was tightly closed, and after the loading of 43.5 g 1,3-butadiene, the inner temperature was elevated to 60° C. Then, 1.125 g potassium persulfate dissolved in 40 ml water was added to the reaction vessel, and the content was stirred for 8 hours. The temperature was raised to 90° C. for additional 3 hours stirring. After the reaction terminated, the content was cooled to room temperature. The resulting polymer latex was filtered through a piece of paper towel; the latex was condensed with an evaporator to a solid content of 45% by weight under reduced pressure. Finally, 320 g of P-1 was obtained.

To the image-forming layer of the photothermographic image-recording material of the invention, a hydrophilic polymer such as gelatin, poly(vinyl alcohol), methyl cellulose or hydroxypropyl cellulose may be added in case of necessity. The amount of such a hydrophilic polymer does not exceed 30% by weight preferably, and more preferably 20% by weight of the total amount of binder for the organic silver salt-containing layer.

From the viewpoint of coated surface uniformity, a very preferable organic silver salt-containing layer results when a coating composition is coated and dried comprising a medium 30% by weight or more of which is water and when the binder is dispersible in an aqueous medium and consists of a polymer latex that exhibits an equilibrium moisture content not exceeding 2% by weight at 25° C., 60% RH. A form prepared so as to have an ionic conductivity not exceeding 2.5 mS/cm is most preferable. Such low ionic conductivity values can be realized by purifying a synthesized polymer with a separating membrane.

Organic solvents that can be used together with water as the medium for the polymer dispersion described above preferably include a water-miscible organic solvent and include, for example, alcohols such as methyl, ethyl or propyl alcohol, cellosolves such as methyl, ethyl or butyl cellosolve, ethyl acetate and dimethylformamide. The content of such a water-miscible organic solvent does not exceed 50% by weight preferably, more preferably 30% by weight of the water. Some preferable examples of medium composition are pure water, mixtures such as water/methyl alcohol=90/10, water/methyl alcohol=70/30, water/methyl alcohol/dimethylformamide=80/15/5, water/methyl alcohol/ethyl cellosolve=80/15/5 and water/methyl alcohol/isopropyl alcohol=85/10/5 expressed by % by weight.

The binder polymer used in the invention preferably has an equilibrium moisture content, at 25° C., 60% RH, not exceeding 2% by weight, more preferably between 0.01 and 1.5% by weight, and still more preferably between 0.02 and 1% by weight.

The "equilibrium moisture content at 25° C., 60% RPH" can be expressed as follows by using W1 designating the polymer weight equilibrated under an atmosphere of 25° C., 60% RH, and WO designating the polymer weight in an absolutely dry state at 25° C.

Equilibrium moisture content at 25° C., 60% $RH=[(W1-W0)/W0]\times 100$ (% by weight)

As for the definition of moisture content and its measurement, reference can be made to, for example, *Kobunshi Kougaku Koza* 14, *Kobunshi Zairyo Shiken-hou* (*Polymer Engineering Lecture Series* 14, *Polymer Material Test Method), edited by the Society of Polymer Science, Japan and published by Chijin Shokan Co., Ltd.*

The organic silver salt-containing (i.e., image-forming) layer of the photothermographic image-recording material of the invention is preferably made by using a polymer latex. The content of the binder in the organic silver salt-containing layer is preferably such as to make the weight ratio of total binder/organic silver salt equal to 1/10 to 10/1, and more preferably 1/5 to 4/1.

Such an organic silver salt-containing layer, which usually contains a photosensitive silver halide, usually acts as a photosensitive (emulsion) layer. In such a case, the weight ratio of the total binder to the silver halide is preferably from 400 to 5, and more preferably from 200 to 10.

The total amount of the binder for the image-forming layer is preferably from 0.2 to 30 g/m$^2$, and more preferably from 1 to 15 g/m$^2$. In the image-forming layer, various additives such as an agent to crosslink the binder, or a surfactant to improve the coating ability of the coating mixture may be incorporated.

The photothermographic image-recording material of the invention contains a silver ion-reducing agent. Preferable silver ion-reducing agents include phenol compounds, and o-polyphenols are particularly preferred as they have a high heat-developing capability.

In this specification, the "o-polyphenol compound" means any compound that acts as a reducing agent and contains the following structure in its molecule.

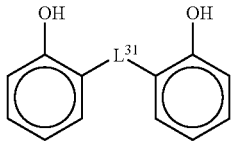

Among such compounds, those represented further by formula (3) are particularly preferred due to their high heat-developing activity.

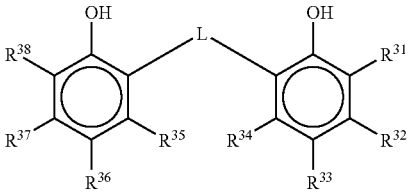

(3)

The compounds represented by formula (3) will be described in detail below.

In formula (3), $R^{31}$ to $R^{38}$ each independently represents hydrogen or groups that can be substituted to a benzene ring. Groups that can be substituted to a benzene ring include halogen, an alkyl group, an aryl group, an aralkyl group, an alkoxy group, an acylamino group, a sulfamido group, an acyl group, a carbamoyl group, a sulfamoyl group, an alkoxycarbonyl group, a sulfonyl group, an alkoxyalkyl group or an acylaminoalkyl group. The alkyl group is exemplified by methyl, ethyl, propyl, butyl, isopropyl, tert-butyl tert-amyl, cyclohexyl or 1-methylcyclohexyl. An example of the aralkyl group is benzyl.

$R^{31}$ $R^{33}$, $R^{36}$ and $R^{38}$ each preferably represents independently an alkyl group, more preferably either of a primary alkyl group of 1 to 20 carbon atoms, a secondary alkyl group of 3 to 20 carbon atoms or a tertiary alkyl group of 4 to 20 carbon atoms.

Each of these groups described above may have a substituent. Such substituents include a halogen atom, an aryl, heterocyclic, alkoxy, aryloxy, alkylthio, arylthio, hydroxyl, acyloxy, amino, alkoxycarbonyl, acyl, acylamino, oxycarbonyl, carbamoyl, sulfonyl, sulfamoyl, sulfonamido, phosphoryl or carboxyl group.

The primary alkyl groups include methyl, ethyl, propyl, butyl, pentyl, hexyl, heptyl, octyl, nonyl, decyl, dodecyl, benzyl, methoxymethyl, 2-methoxyethyl, phenethyl or hexyloxycarbonylmethyl. Among them, methyl and ethyl are preferred.

The secondary alkyl groups include isopropyl, isobutyl isooctyl, cyclohexyl, cyclopentyl, 1-methoxymethyl-ethyl or 1-butoxyethyl-ethyl. Among them, unsubstituted secondary alkyl groups are preferred, and isopropyl and cyclohexyl groups are more preferred.

The tertiary alkyl groups include tert-butyl, tert-amyl, tert-octyl, 1-methylcyclohexyl, 1-methylcyclopentyl, 1-methylcyclopropyl, 1-methyl-1-phenylethyl or 1,1-dimethyl-4-hexyloxycarbonylbutyl. Among them, unsubstituted tertiary alkyl groups are preferred, and tert-butyl and 1-methylcyclohexyl are more preferred. The most preferred one is tert-butyl.

$R^{31}$ and $R^{38}$ each preferably represents independently a secondary or tertiary alkyl group. When a secondary or tertiary alkyl group is chosen, the developing activity is high. Thus, the manufacturing cost and labor load of the photothermographic material can be markedly reduced as the coating amount is reduced. Though the developing activity is high when a secondary or tertiary alkyl group is chosen, image stability badly deteriorates if a phosphoryl group-containing compound is not used together. However, by combination according to the invention, image stability markedly improves. A tertiary alkyl group is preferably selected as $R^{31}$ and $R^{38}$ from developing activity viewpoint. $R^{31}$ may be the same as or different from $R^{38}$, but is preferably the same.

$R^{33}$ and $R^{36}$ are preferably unsubstituted alkyl groups exemplified by methyl, ethyl, propyl, butyl, isopropyl, tert-butyl, tert-amyl, cyclohexyl or 1-methylcyclohexyl. Among them, more preferably ones are methyl, ethyl, isopropyl and tert-butyl. The most preferable groups are methyl and ethyl.

$R^{32}$, $R^{34}$, $R^{35}$ and $R^{37}$ each preferably represents independently hydrogen, a halogen atom, or an alkyl group, and more preferably hydrogen.

L represents —S— or —$CHR^{39}$—, wherein $R^{39}$ represents hydrogen or an alkyl group. Alkyl groups of 1 to 20 carbon atoms which may be unsubstituted or substituted with other groups are preferred as the alkyl group. Examples of the unsubstituted alkyl groups include, methyl, ethyl, propyl, butyl, heptyl, undecyl, isopropyl, 1-ethylpentyl and 2,4,4-trimethylpentyl. Preferable substituents for the alkyl group are common to those for $R^{31}$, $R^{33}$, $R^{36}$ and $R^{38}$. More preferably, $R^{39}$ is hydrogen or an unsubstituted alkyl group of 1 to 12 carbon atoms, still more preferably hydrogen or an alkyl group of 1 to 7 carbon atoms, and particularly preferably hydrogen, methyl or n-propyl.

Some specific compounds represented by formula (3) applicable to the invention will be shown, but the phenol compounds used in the invention is not limited to these compounds at all.

(3-1)

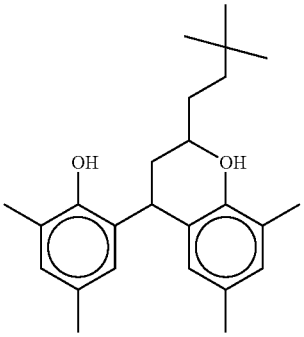

(3-2)

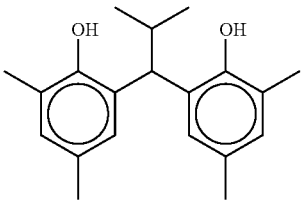

(3-3)

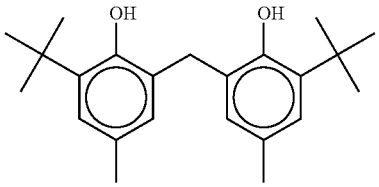

(3-4)

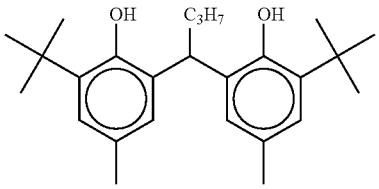

(3-5)

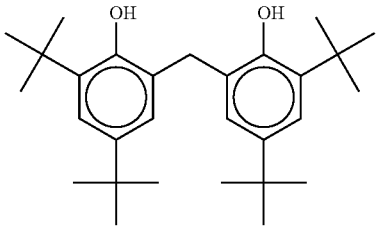

-continued (3-6)

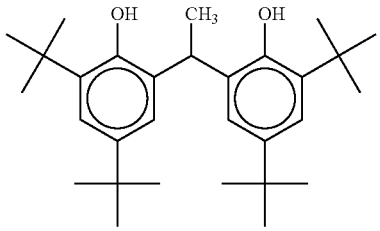

(3-7)

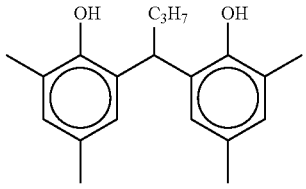

(3-8)

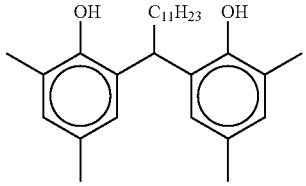

(3-9)

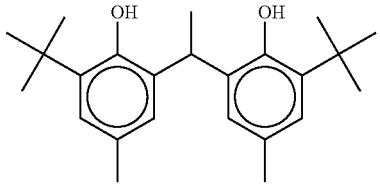

(3-10)

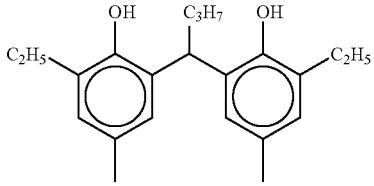

(3-11)

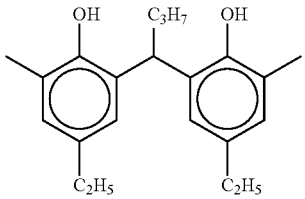

(3-12)

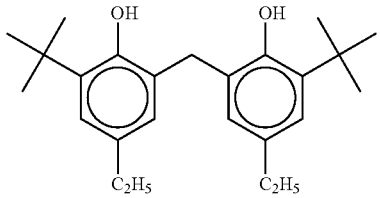

(3-13)

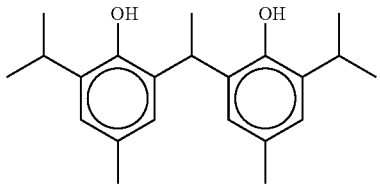

-continued
(3-14)
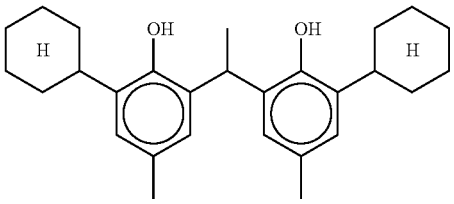
(3-15)
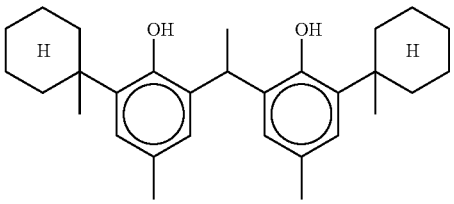
(3-16)
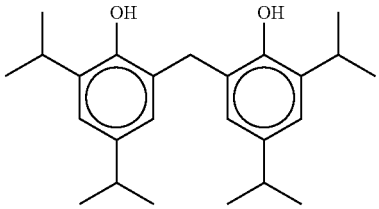
(3-17)
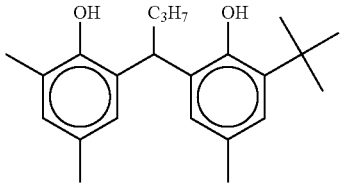
(3-18)
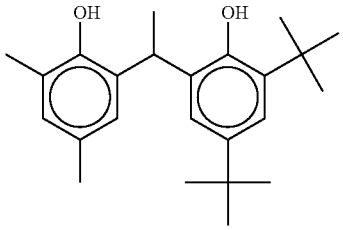
(3-19)
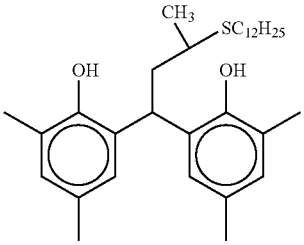
(3-20)
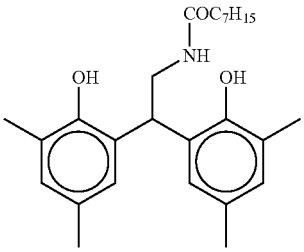
-continued
(3-21)
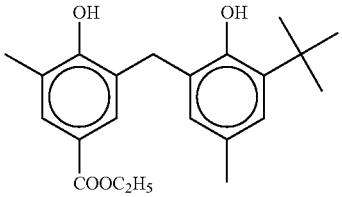
(3-22)
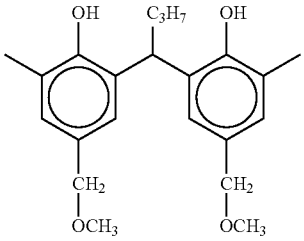
(3-23)
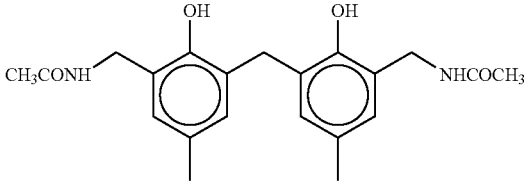
(3-24)
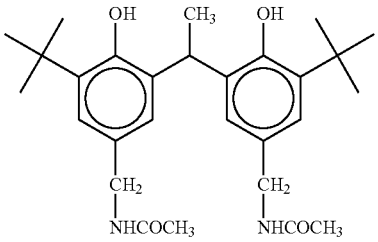
(3-25)
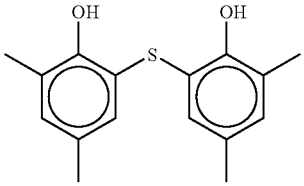
(3-26)
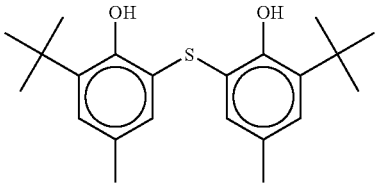
(3-27)
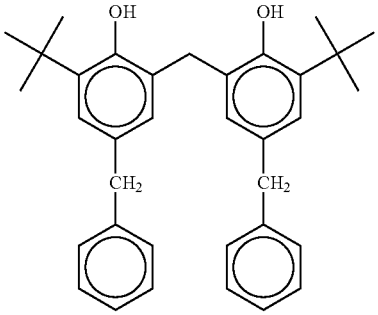

-continued (3-28)

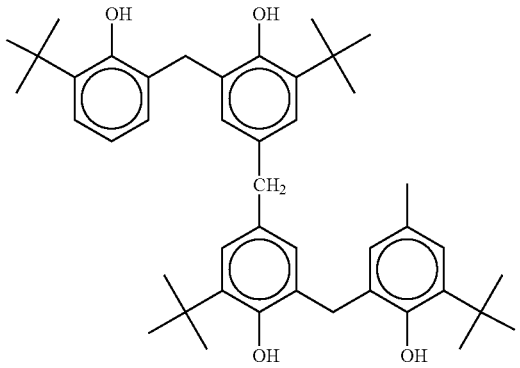

(3-29)

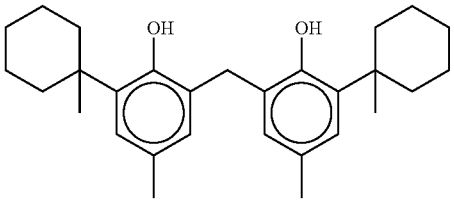

(3-30)

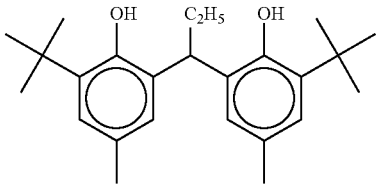

(3-31)

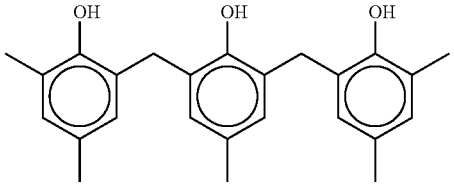

(3-32)

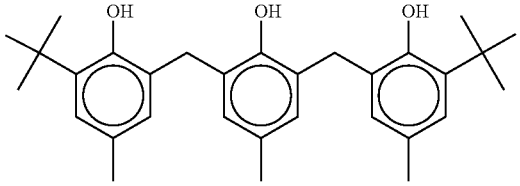

(3-33)

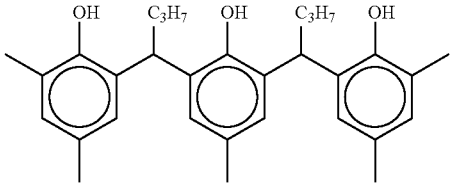

(3-34)

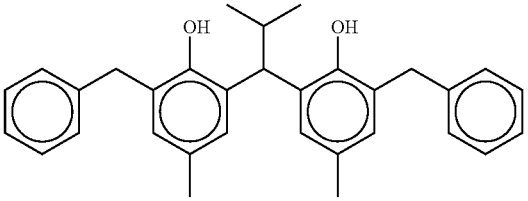

Still other phenol compounds applicable to the invention include those described in EP-A-0803764 and JP-A-51-51933 and JP-A-6-3793.

The use amount of the reducing agent, which is preferably a phenol compound, is preferably 0.01 to 4.0 g/m$^2$, and more preferably 0.1 to 2.0 g/m$^2$. The reducing agent is preferably contained in 2 to 40 mole %, and more preferably in 5 to 30 mole %, based on 1 mole silver contained in the image-forming layer.

The reducing agent can be incorporated in the coating solution in any form including solution, emulsified dispersion, or finely divided solid particle dispersion and can be added to the resulting image-recording material.

An example of well-known emulsification dispersion methods comprises dissolving the agent in an oil such as dibutyl, tricresyl or diethyl phthalate or glyceryl triacetate, or in an auxiliary solvent such as ethyl acetate or cyclohexanone, and mechanically dispersing the resulting solution to form an emulsified dispersion.

Finely divided solid particle dispersions can be prepared by dispersing the pulverized reducing agent in a suitable medium such as water by means of ball mill, colloid mill, vibrating ball mill, sand mill, jet mill, roller mill or ultrasonic wave. For such procedures, a protective colloid (e.g., poly(vinyl alcohol)) or a surfactant (e.g., anionic surfactant such as sodium triisopropylnaphthalenesulfonate comprising a mixture of compounds in which the substituted positions of the three isopropyl groups vary). Water dispersion may contain an antiseptic (e.g., sodium salt of benzoisothiazolinone).

The photothermographic image-recording material of the invention preferably contains a compound having a phosphoryl group.

The "phosphoryl group-containing compound" used in the invention (sometimes described as phosphoryl compound hereinafter) means any compound containing at least one phosphoryl group in the molecule, preferably represented by the following formula (4).

(4)

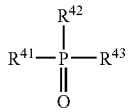

In formula (4), $R^{41}$, $R^{42}$ and $R^{43}$ each represents independently an alkyl group, an aryl group, an aralkyl group, an alkoxy group, an aryloxy group, an amino group or a heterocyclic group, which may be unsubstituted or have a substituent.

The alkyl group preferably includes substituted or unsubstituted, straight-chain, branched-chain, cyclic ones or combinations of these containing 1 to 20 carbon atoms. Specific examples are methyl, ethyl, butyl, octyl, dodecyl, isopropyl, t-butyl, t-amyl, t-octyl, cyclohexyl and 1-methylcyclohexyl.

The aryl group preferably includes mono-cyclic or polycyclic, substituted or unsubstituted ones of 6 to 20 carbon atoms, exemplified by phenyl, cresyl, xylyl, naphthyl, 4-t-butylphenyl, 4-t-octylphenyl, 4-anisidyl and 3,5-dichlorophenyl.

Preferable examples of the aralkyl group includes those of 7 to 27 carbon atoms such as benzyl, phenethyl, 2-phenoxypropyl.

The alkoxy group preferably includes substituted or unsubstituted, straight-chain, branched-chain, cyclic ones or combinations of these containing 1 to 20 carbon atoms. Specific examples are methoxy, ethoxy, butoxy, octyloxy, 2-ethylhexyloxy, 3,5,5-trimethylhexyloxy, dodecyloxy, cyclohexyloxy, 4-methylcyclohexyloxy and benzyloxy.

As the aryloxy group, those of 6 to 20 carbon atoms are preferred including phenoxy, cresyloxy, isopropylphenoxy, 4-t-butylphenoxy, naphthoxy and biphenyloxy.

Preferable examples of the amino group are those of 0 to 20 carbon atoms including dimethylamino, diethylamino, dibutylamino, dioctylamino, N-methyl-N-hexylamino, dicyclohexylamino, diphenylamino and N-methyl-N-phenylamino.

The heterocyclic group includes three- to ten-membered saturated or unsaturated heterocyclic ones containing at least one N, O or S atom. They may be monocyclic or form a condensed ring with another cyclic group. Specific examples of the heterocyclic ring in the heterocyclic group are pyrrolidine, piperidine, piperazine, morpholine, thiophene, furan, pyrrole, imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanethroline, phenazine, tetrazole, thiazole, oxazole, benzimidazole, benzoxazole, benzothiazole, benzoselenazole, indolenine and tetrazaindene.

$R^{41}$, $R^{42}$ and $R^{43}$ each represents preferably an alkyl group, an aryl group, an alkoxy group or an aryloxy group. More preferably, at least one of $R^{41}$, $R^{42}$ and $R^{43}$ is an alkyl group or an aryl group, and more preferably, two or more of them are an alkyl group or an aryl group. From the viewpoint of economical availability, $R^{41}$, $R^{42}$ and $R^{43}$ preferably represent the same group. In the case where $R^{41}$, $R^{42}$ or $R^{43}$ has a substituent, preferable substituents include a halogen atom, an alkyl group, an aryl group, an alkoxy group, an amino group, an acyl group, an acylamino group, an alkylthio group, an arylthio group, a sufonamido group, an acyloxy group, an oxycarbony group, a carbamoyl group, a sulfamoyl group, a sulfonyl group and a phosphoryl group. Among them, substituted or unsubstituted alkyl, aryl, alkoxy and aryloxy groups are preferred exemplified by methyl, ethyl, isopropyl, t-butyl, t-octyl, phenyl, 4-alkoxyphenyl, 4-acyloxyphenyl, methoxy and phenoxy.

Some specific examples of the phosphoryl group-containing compounds used in the invention will be shown below, but the invention is not limited to the following exemplary compounds.

(4-1)

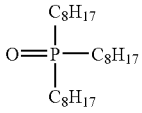

(4-2)

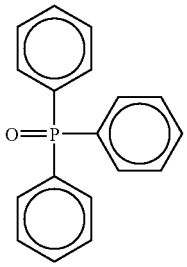

-continued (4-3)

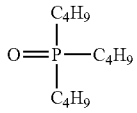

(4-4)

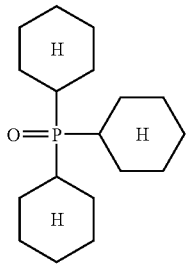

(4-5)

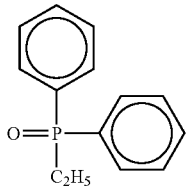

(4-6)

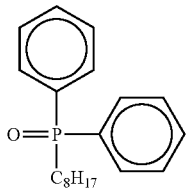

(4-7)

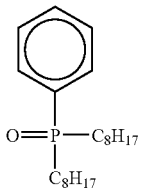

(4-8)

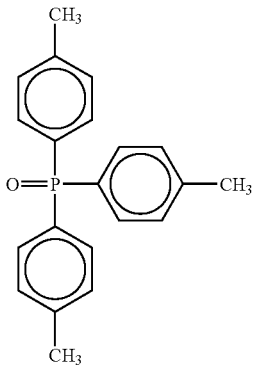

-continued
(4-9)
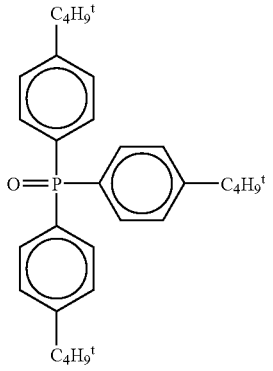
(4-10)
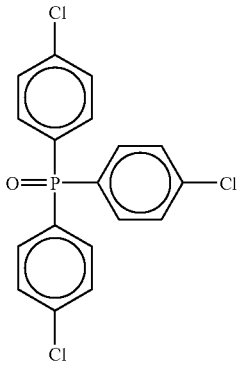
(4-11)
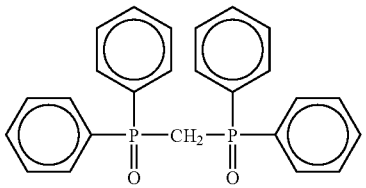
(4-12)
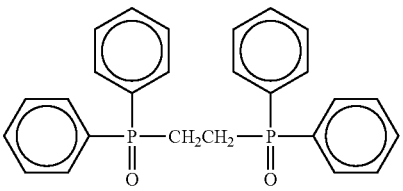
(4-13)
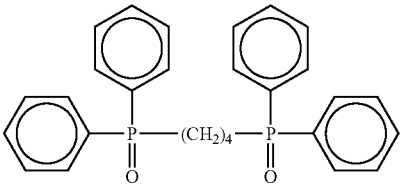
(4-14)
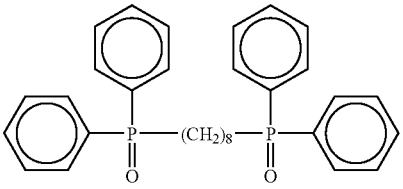
-continued
(4-15)
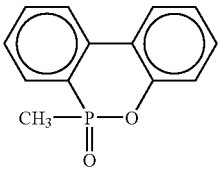
(4-16)
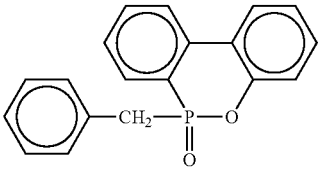
(4-17)
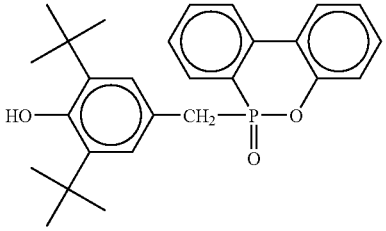
(4-18)
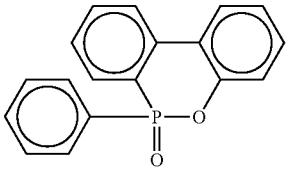
(4-19)
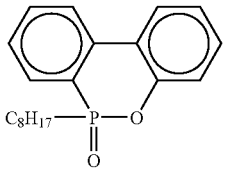
(4-20)
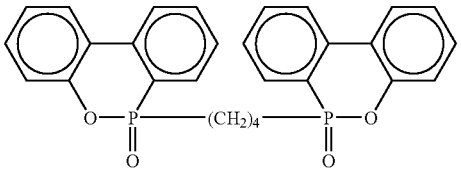
(4-21)
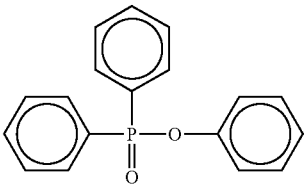
(4-22)
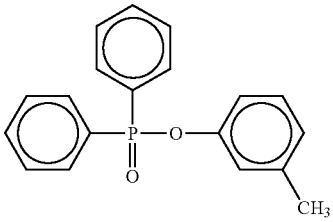

-continued
(4-23)
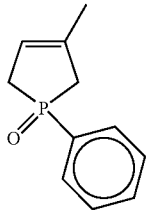
(4-24)
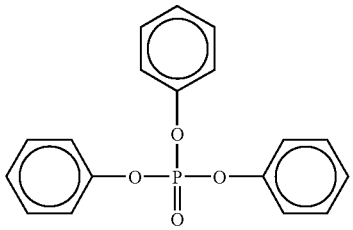
(4-25)
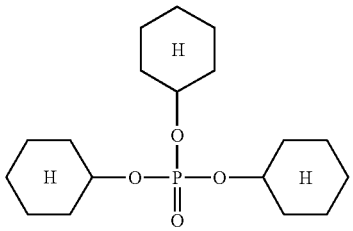
(4-26)
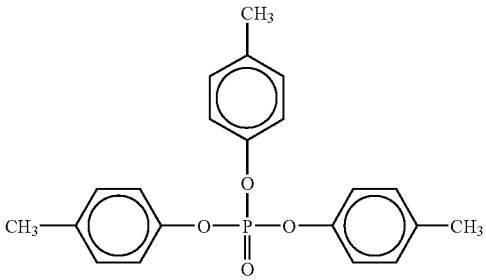
(4-27)
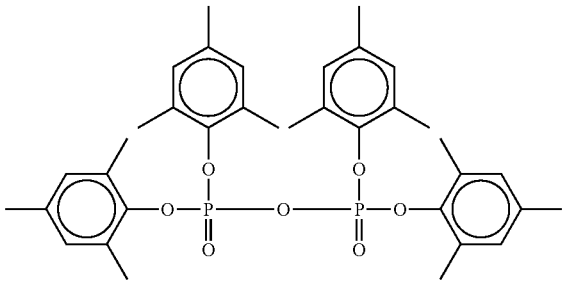
(4-28)
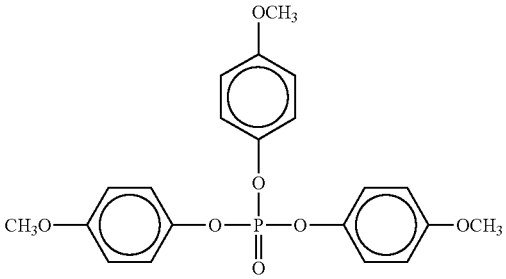
-continued
(4-29)
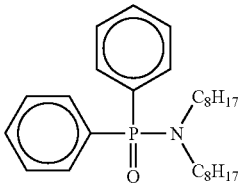
(4-30)
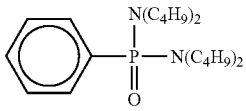
(4-31)
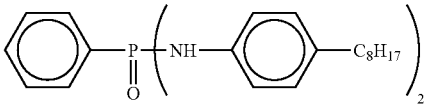
(4-32)
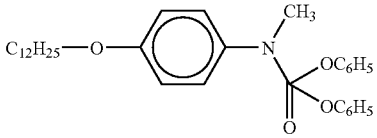
(4-33)
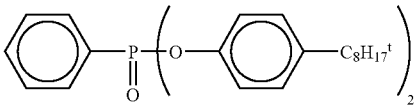
(4-34)
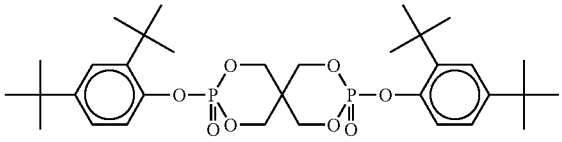
(4-35)
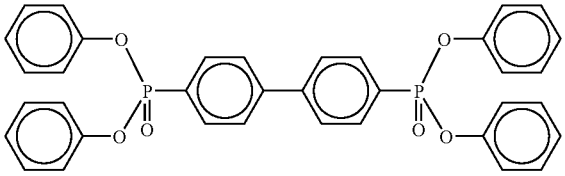
(4-36)
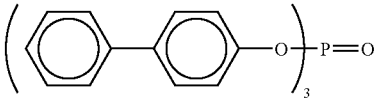
(4-37)
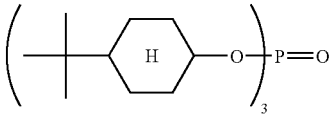
(4-38)
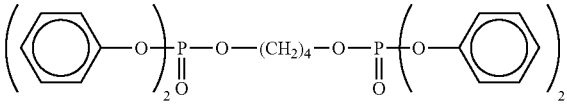

-continued (4-39)

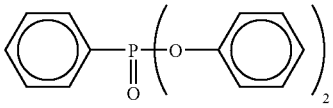

(4-40)

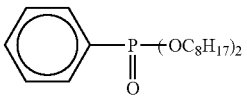

(4-41)

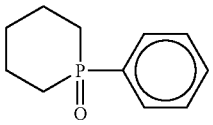

(4-42)

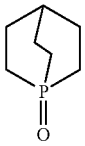

(4-43)

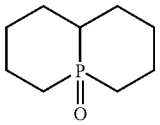

(4-44)

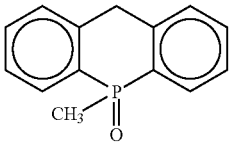

(4-45)

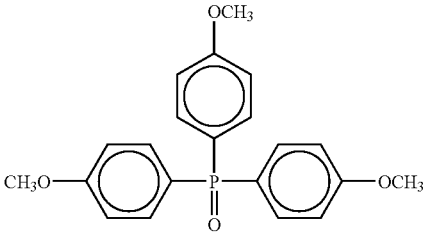

(4-46)

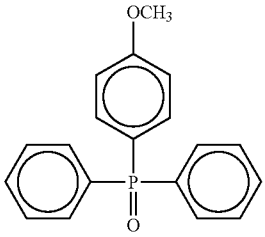

(4-47)

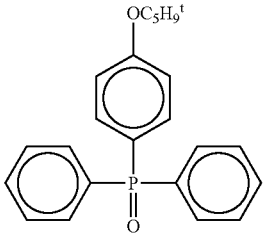

-continued (4-48)

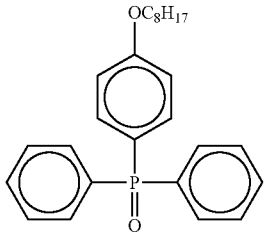

(4-49)

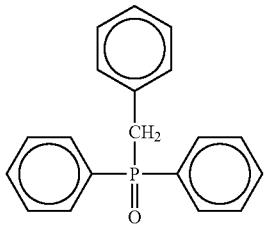

(4-50)

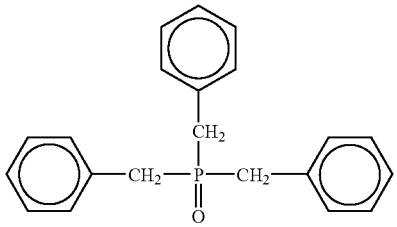

The added amount of the phosphoryl compound (preferably represented by formula (4)) is preferably from 0.01 to 4.0 g/m$^2$, and more preferably 0.1 to 2.0 g/m$^2$. This type of compound is preferably contained in 2 to 40 mole %, and more preferably in 5 to 30 mole %, based on 1 mole silver contained in the image-forming layer.

The molar ratio of the phenolic reducing agent (preferably represented by formula (3)) to the phosphoryl compound is preferably from 0.1 to 10, more preferable from 0.1 to 2.0, and still more preferably from 0.5 to 1.5.

Both of the phenol compound (preferably represented by formula (3)) and the phosphoryl compound (preferably represented by formula (4)) are preferably incorporated in the image-forming layer containing an organic silver salt, but either of them may be incorporated in the image-forming layer with the other contained in a non-image-forming layer formed adjacent to the image-forming layer. Furthermore, it is possible to incorporate both of them in such a non-image-forming layer. In cases where the image-forming layer comprises plural sub-layers, each of the two compounds may be incorporated in a different sub-layer.

The weight ratio of the phosphoryl compound to the binder in the image-forming layer is preferably in the range of from 0.005 to 1.0, and particularly preferably from 0.025 to 0.5. Further, the weight ratio of the silver ion reducing agent to the binder in the image-forming layer is preferably in the range of from 0.01 to 1.0 and particularly preferably from 0.05 to 0.5.

The photothermographic image-recording material of the invention preferably comprises a polyhalogen compound. Polyhalogen compounds represented by the following formula (5) are particularly preferred.

$$Q^{51}\text{-}(Y^{51})_k\text{—}CZ^{51}Z^{52}X^{51} \quad (5)$$

In formula (5), $Q^{51}$ represents an alkyl group, an aryl group or a heterocyclic group each of which may have a substituent, $Y^{51}$ represents a divalent connecting group, k represents 0 or 1, $Z^{51}$ and $Z^{52}$ each represents a halogen atom, and $X^{51}$ represents hydrogen or an electron-attracting group.

Formula (5) will be explained more in detail below.

In formula (5), $Q^{51}$ represents an alkyl group, an aryl group or a heterocyclic group, each of which may have a substituent. The alkyl group represented by $Q^{51}$ in formula (5) includes straight-chain, branched-chain or cyclic ones preferably of 1 to 20, more preferably 1 to 12, and particularly preferably 1 to 6 carbon atoms. Its examples are methyl, ethyl, allyl, n-propyl, isopropyl, sec-butyl, iso-butyl, tert-butyl, sec-pentyl, iso-pentyl, tert-pentyl, tert-octyl and 1-methylcyclohexyl. Among them, tert-alkyl groups are preferred.

The alkyl group represented by $Q^{51}$ may have any substituent inasmuch as the substituent will exert no photographically adverse effect. Examples are a halogen atom (F, Cl, Br or I), an alkyl group, an alkenyl group, an alkynyl group, an aryl group, a heterocyclic group (including N-substituted nitrogen-containing ones such as morpholino), an alkoxycarbonyl group, an aryloxycarbonyl group, a carbamoyl group, an imino group, an N-substituted imino group, a thiocarbonyl group, a carbazoyl group, a cyano group, a thiocarbamoyl group, an alkoxy group, an aryloxy group, a heterocyclic-oxy group, an acyloxy group, an (alkoxy- or aryloxy-) carbonyloxy group, a sulfonyloxy group, an acylamido group, a sulfonamido group, a ureido group, a thioureido group, an imido group, an (alkoxy- or aryloxy-) carbonylamino group, a sulfamoylamino group, a semicarbazido group, a thiosemicarbazido group, an (alkyl- or aryl-) sulfonylureido group, a nitro group, an (alkyl- or aryl-) sulfonyl group, a sulfamoyl group, groups containing a phosphoric acid amide or phosphoric acid ester structure, a silyl group, a carboxyl group or its salt, a sulfo group or its salt, a phosphoric acid group, a hydroxy group and a quaternary ammonium group. These substituents may further be substituted by the groups describeded here.

The aryl group represented by $Q^{51}$ of formula (5) has a monocyclic or condensed ring structure of preferably 6 to 20, more preferably 6 to 16, and particularly preferably 6 to 10 carbon atoms. Practically, phenyl or naphthyl group is preferred.

The aryl group represented by $Q^{51}$ may have any substituent inasmuch as the substituent will exert no photographically adverse effect. Examples are common to those described as the substituent for the alkyl group.

The heterocyclic group represented by $Q^{51}$ includes preferably saturated or unsaturated monocyclic or condensed, 5- or 7-membered ones containing, in the heterocyclic ring, at least one hetero atom selected from the group comprising N, O and S. Preferable examples include pyridine, quinoline, isoquinoline, pyrimidine, pyrazine, pyridazine, phthalazine, triazine, furan, thiophene, pyrrole, oxazole, benzoxazole, thiazole, benzothiazole, imidazole, benzimidazole, thiadiazole and triazole. More preferable examples are pyridine, quinoline, pyrimidine, thiadiazole and benzothiazole, while particularly preferred ones are pyridine, quinoline and pyrimidine.

The heterocyclic group represented by $Q^{51}$ may have any substituent. Examples are common to those described as the substituent for the alkyl group represented by $Q^{51}$ of formula (5)

In summary, preferable groups as $Q^{51}$ are phenyl, naphthyl, quinolyl, pyridyl, pyrimidyl, thiadiazolyl and benzothiazolyl, among which phenyl, naphthyl, quinolyl, pyridyl and pyrimidyl are particularly preferred.

The substituent for $Q^{51}$ may contain a ballast group often used in photographic materials to lower the diffusibility, a group to be readily adsorbed by silver salts, or such a group as to impart water-solubility. The substituents may form a polymer as the result of polymerization. Alternatively, two or more substituents may connect together to form a bis-, tris- or tetraquis-form.

In formula (5), $Y^{51}$ represents a divalent connecting group, which is preferably —$SO_2$—, —SO— or —CO—, —$SO_2$— being most preferred.

In formula (5), k represents 0 or 1, but 1 is preferred.

In formula (5), $Z^{51}$ and $Z^{52}$ each represents independently a halogen atom (e.g., F, Cl, Br or I), but both of $Z^{51}$ and $Z^{52}$ are most preferably Br.

In formula (5), $X^{51}$ represents hydrogen or an electron-attracting group. The electron-attracting group represented by $X^{51}$ is a substituent which can have a positive Hammett's substituent value $\sigma_p$, specific examples being a cyano group, an alkoxycarbonyl group, an aryloxycarbonyl group, a carbamoyl group, an sulfamoyl group, an alkylsulfonyl group, an arylsulfonyl group, a halogen atom, an acyl group or a heterocyclic group. Preferable groups for $X^{51}$ are hydrogen and a halogen atom, Br being most preferred.

The organic polyhalogen compound represented by formula (5) includes those described in, for example, U.S. Pat. Nos. 3,874,946, 4,756,999, 5,340,712, 5,369,000, and 5,464,737 and JP-A-50-137126, JP-A-50-89020, JP-A-50-119624, JP-A-59-57234, JP-A-7-2781, JP-A-7-5621, JP-A-9-160164, JP-A-10-197988, JP-A-9-244177, JP-A-9-244178, JP-A-9-160167, JP-A-9-319022, JP-A-9-258367, JP-A-9-265150, JP-A-9-319022, JP-A-10-197989, JP-A-11-242304, JP-A-10-292864, JP-A-2000-284412, JP-A-2000-284410 and JP-A-2000-33911.

In the following, preferable chemical structures of the compounds represented by formula (5) will be explained more in detail.

In formula (5), $Q^{51}$ preferably represents a phenyl group substituted with an electron-attracting group a Hammett's value $\sigma_p$ of which is preferably positive. Such electron-attracting group includes a cyano group, an alkoxycarbonyl group, an aryloxycarbonyl group, a carbamoyl group, a sulfamoyl group, an alkylsulfonyl group, an arylsulfonyl group, a sulfoxido group, an acyl group, a heterocyclic group, a halogen atom, a halogenated alkyl group or a phosphoryl group. A preferable range for $\sigma_p$ is from 0.2 to 2.0, and more preferably from 0.4 to 1.0. Among the electron-attracting groups, a carbamoyl group, an alkoxycarbamoyl group, an alkylsulfonyl group or an alkylphosphoryl group is particularly preferable, and a carbamoyl group is most preferred.

Practical compounds represented by formula (5) will follow. The invention is not limited to those compounds at all.

(5-1)

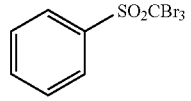

(5-2)

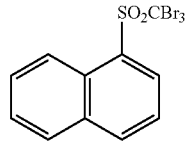

-continued
(5-3)
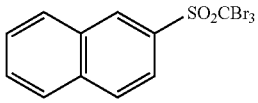
(5-4)
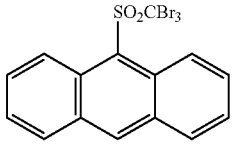
(5-5)
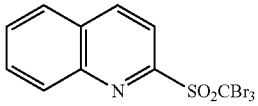
(5-6)
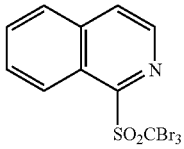
(5-7)
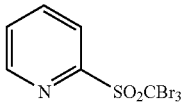
(5-8)
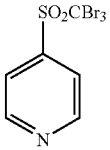
(5-9)
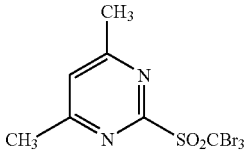
(5-10)
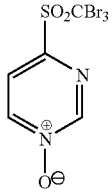
(5-11)
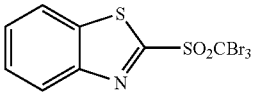
(5-12)
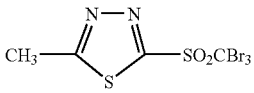
(5-13)
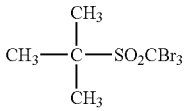
-continued
(5-14)
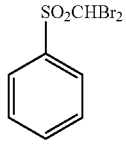
(5-15)
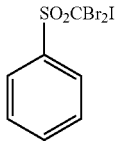
(5-16)
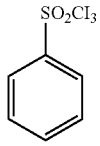
(5-17)
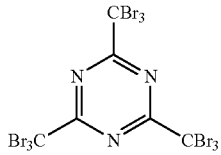
(5-18)
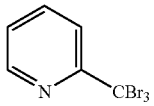
(5-19)
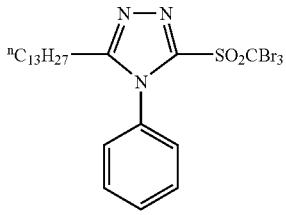
(5-20)
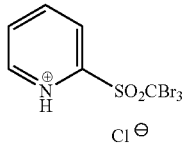
(5-21)
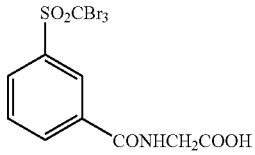
(5-22)
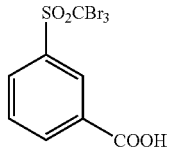
(5-23)
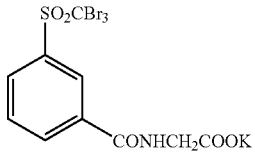

-continued
(5-24)
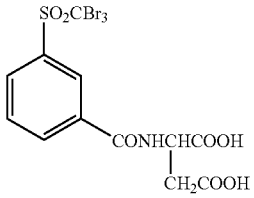
(5-25)
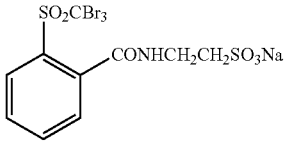
(5-26)
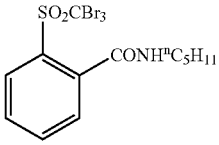
(5-27)
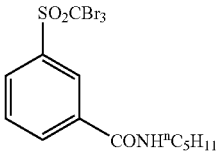
(5-28)
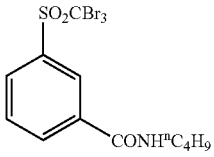
(5-29)
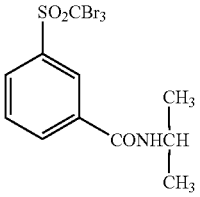
(5-30)
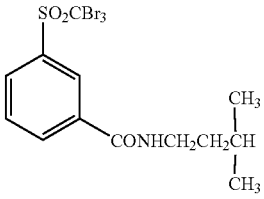
(5-31)
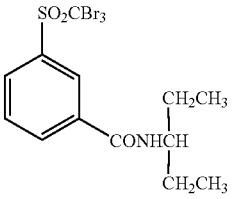
-continued
(5-32)
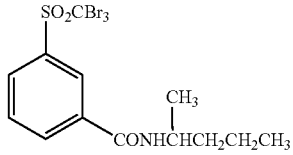
(5-33)
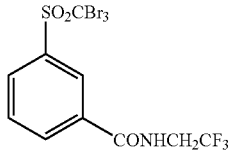
(5-34)
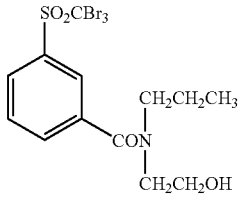
(5-35)
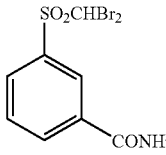
(5-36)
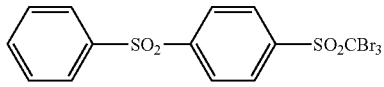
(5-36)
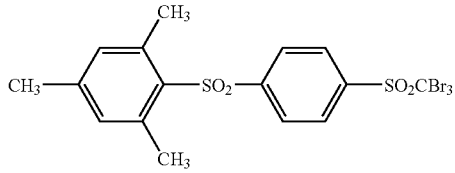
(5-37)
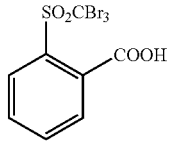
(5-38)
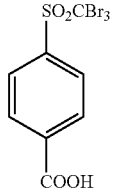
(5-40)
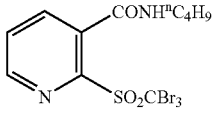
The organic polyhalogen compound represented by formula (5) may be used individually or in combination of two or more kinds. The coated amount per 1 $m^2$ of the photothermographic image-recording material is preferably from $1\times10^{-6}$ to $1\times10^{-2}$ moles, more preferably from $1\times10^{-5}$ to $5\times10^{-3}$ moles, and still more preferably from $2\times10^{-5}$ to $2\times10^{-3}$ moles.

The organic polyhalogen compound represented by formula (5) may be incorporated in any layer provided on the image-forming layer side of the support inclusive of the image-forming layer. Preferably, the polyhalogen compound is incorporated in the image-forming layer or its adjacent layer.

The organic silver salts applicable to the invention are those relatively stable to light, but able to form a silver image when heated to 80° C. or higher under the presence of an exposed photo-catalyst (e.g., latent images formed in photosensitive silver halide) and a reducing agent. Such organic silver salts may be of arbitrary organic substances containing a source for the reduction of silver ion. As the photo-insensitive organic silver salts satisfying these conditions, the silver salts of organic acids described in paragraph Nos. 0048 to 0049 of JP-A-10-62899 and in the 24th line, p. 18 to the 37th line, p. 19 of EP-A-0803764 are preferred. Particularly, the silver salt of a long-chain aliphatic carboxylic acid of 10 to 30, and more preferably 15 to 28 carbon atoms are preferred. Practical examples of such preferable organic silver salts include, silver behenate, silver alachidate, silver stearate, silver oleate, silver laurate, silver capronate, silver milistate and silver palmitate. Mixtures of these salts can also be used.

The organic silver salt used in the invention can take any grain shape without special limitation, but scaly ones are preferred. In the present specification, the scaly organic silver salt is defined as follows. A sample of an organic silver salt grain is observed with an electron microscope. The shape of the grains is approximated by a rectangular parallelepiped, the three edge lengths of which are designated A, B and C in extending order whereby C may be equal to B. By using A and B thus defined, a value x is obtained as $$x=B/A$$

From the x's on about 200 grains, the average value, x(average) is obtained. When x(average) is not smaller than 1.5 (x(average)≧1.5), the grain is described as scaly. Preferably, 30≧x(average)≧1.5, and more preferably, 20≧x(average)≧2.0. Incidentally, for noodle shape, 1.5>x(average)≧1.

In a scaly grain, A can be regarded as the thickness of a tabular grain in which the plane having the edges of B and C in length forms the main plane. The average length of A is preferably 0.01 to 0.23 μm, and more preferably 0.1 to 0.20 μm. The average value of C/B is preferably 1 to 6, more preferably 1.05 to 4, still more preferably 1.1 to 3, and particularly preferably 1.1 to 2.

The organic silver salt preferably has a mono-disperse size distribution. In such a mono-disperse distribution, the percentage of the value obtained by dividing the standard deviation of length of the short or long axis by the corresponding axial length does not exceed 100% preferably, be more preferably not larger than 80%, and particularly preferably not larger than 50%. The shape of the organic silver salt can be measured from transmission electron micrographs of the dispersion of the salt. Another method of measuring the degree of mono-dispersion is based on the standard deviation of the volume-weighted average diameter of the organic silver salt. In such a method, the percentage of the volume obtained by dividing the standard deviation of the volume-weighted average diameter by the volume-averaged diameter (coefficient of variation) does not exceed 100% preferably, more preferably be not larger than 80%, and still more preferably not larger than 50%. The volume-weighted average diameter can be obtained by irradiating laser light to the organic silver salt dispersed in a liquid medium, and deriving the auto-correlation function for the temporal change in the fluctuation of the light scattered by the dispersion.

The organic silver salt used in the invention can be prepared by reacting the solution or suspension of the alkali metal (Na, K or Li) salt of the organic acid cited previously with silver nitrate. The alkali metal salt of the organic acid can be prepared by treating the organic acid with an alkaline compound. The organic silver salt can be prepared via a batch or continuous mode in an arbitrary, suitable reaction vessel. The reaction mixture in the vessel can be stirred by an arbitrary agitation method according to the characteristics required to the resulting grains. In the preparation of the organic silver salt, such processes can be preferably adopted as one comprising gradual or abrupt addition of silver nitrate aqueous solution to the reaction vessel containing the solution or suspension of the alkali metal salt of an organic acid, one comprising gradual or abrupt addition of the solution or suspension of the alkali metal salt of an organic acid having been prepared in advance to the reaction vessel containing the silver nitrate aqueous solution, or one comprising simultaneous injection of the silver nitrate aqueous solution and the solution or suspension of the organic alkali metal salt of the organic acid, both having been prepared in advance, into the reaction vessel.

The concentration of silver nitrate aqueous solution and the solution or suspension of the alkali metal salt of the organic acid can be varied arbitrarily, and the addition rate can be also varied arbitrarily in order to control the grain size of the organic silver salt. The mode of addition of silver nitrate aqueous solution and the solution or suspension of the alkali metal salt of an organic acid includes one based on a constant addition rate, and one based on accelerated or decelerated addition rate obeying an arbitrary temporal function. The addition may be made either at the liquid surface of reaction solution or in the liquid volume thereof. In the method comprising simultaneous injection of silver nitrate aqueous solution and the solution or suspension of the alkali metal salt of an organic acid, both having been prepared in advance, into the reaction vessel, the injection of either reaction component may precede that of the other. The injection of silver nitrate aqueous solution is preferably preceded. The degree of precession is preferable from 0 to 50, and more preferably from 0 to 25% by volume relative to the total amount of the solution. As is described in JP-A-9-127643, an addition method in which the pH or the silver potential of the reactant is controlled during reaction is preferably adopted in the invention.

The pH of the silver nitrate aqueous solution and the solution or suspension of the alkali metal salt of the organic acid can be appropriately controlled depending on the property required to the resulting grains with use of an arbitrary acid or base material. At the same time, the temperature inside the reaction vessel can be appropriately set in order to, for example, control the size of the resulting grains of the organic silver salt. Needless to say, the temperature of silver nitrate aqueous solution as well as the solution or suspension of the alkali metal salt of the organic acid can be appropriately set at arbitrary values. In order to secure a sufficient level of fluidity, the solution or suspension of the alkali metal salt of the organic acid is preferably kept at a temperature not lower than 50° C.

The organic silver salt to be used in the invention can be preferably prepared in the presence of a tertiary alcohol.

Tertiary alcohols having 15 or less, more preferably 10 or less carbon atom in total are suited. An example of such preferable tert-alcohols is tert-butanol. Though one can add the tert-alcohol at any time during the preparation of the organic silver salt, a preferable method is to use the tert-alcohol in the preparation of the alkali metal salt of an organic acid so as to dissolve the salt. The tert-alcohol is used in a weight ratio of 0.01 to 10, and more preferably 0.03 to 1 to the amount of water as the solvent used for the preparation of the organic silver salt.

Scaly organic silver salt grains to be used in the invention can be preferably prepared in the following manner. In the step where an aqueous solution containing a water-soluble silver salt is reacted with a solution comprising the alkali metal salt of an organic acid dissolved in a tert-alcohol-containing aqueous medium in the reaction vessel (The step may contain the injection of the latter solution to the liquid in the reaction vessel.), a temperature difference is provided of at least 20° C. but not exceeding 85° C. between the liquid charged in the vessel and the solution comprising the alkali metal salt of an organic acid dissolved in a tert-alcohol-containing aqueous medium. In the above description, 'the liquid charged in the vessel' means the aqueous solution of a water-soluble silver salt injected in precession, or water or a mixed solvent of water and tert-alcohol for the case where the two reaction components are simultaneously injected as will be explained soon. Such water or a mixed solvent of water and tert-alcohol may be charged in advance even when the addition of aqueous solution of the water-soluble silver salt precedes.

By maintaining such a temperature difference during the addition of the tert-alcohol-containing aqueous medium containing the alkali metal salt of an organic acid, the crystal morphology of the resulting organic silver salt can be preferably regulated.

The tert-alcohol to be used preferably contains 4 to 6 carbon atoms; such alcohols occupy 70% by volume or less, more preferably 50% by volume or less of the total volume of the aqueous solution of the water-soluble silver salt. The temperature of the aqueous solution is preferably 0 to 50° C., and more preferably 5 to 30° C. In the case where the aqueous solution of water-soluble silver salt and the tert-alcohol-containing aqueous solution of the alkali metal salt of an organic acid are simultaneously injected, a temperature between 5 and 15° C. is preferably chosen for the aqueous solution, as will be described later.

As the water-soluble silver salt, silver nitrate is preferred; its concentration in aqueous solution is preferably 0.03 to 6.5 mol/l, and more preferably 0.1 to 5 mol/l, and the pH of the aqueous solution is preferably 2 to 6, and more preferably from 3.5 to 6.

As the alkali metal suited for the formation of the salt of an organic acid, Na and K are preferred. The alkali metal salt of an organic acid can be prepared by adding NaOH or KOH to the organic acid. In such a reaction, the alkali metal is preferably used in an amount less than the equivalent moles of the organic acid to leave a certain amount of unreacted free acid. The residual amount of organic acid is preferably 3 to 50 mole %, and more preferably 3 to 30 mole % based on 1 mole of the total acid amount. Alternatively, one can prepare a similar product by first using an excessive amount of alkali, and then adding an acid such as nitric acid or sulfuric acid to neutralize the excessive alkali.

The pH may be adjusted depending on the requirement for the resulting organic silver salt with use of an arbitrary acid or base.

The solution containing a water-soluble silver salt, the tert-alcohol-containing aqueous solution of the alkali metal salt of an organic acid, or the liquid charged in the reaction vessel may further contain a compound represented by formula (1) of JP-A-62-65035, a N-containing heterocyclic compound having a water-soluble group described in JP-A-62-150240, an inorganic peroxide described in JP-A-50-101019, a sulfur compound described in JP-A-51-78319, a disulfide compound described in JP-A-57-643 or hydrogen peroxide.

The tert-alcohol-containing aqueous solution of the alkali metal salt of an organic acid preferably comprises a mixed solvent of water and a tert-alcohol of 4 to 6 carbon atoms to secure a homogeneousness of the solution. Those of 7 carbon atoms or more are not preferred due to the lack of the compatibility with water. Among the $C_{4-6}$ tert-alcohols, tert-butanol is most preferred due to the highest compatibility with water. Alcohols other than tertiary ones cannot be used as they have a reducing property, thus exerting an adverse effect in the formation of the silver salt of an organic acid. The amount of the tert-alcohol used in the tert-alcohol-containing aqueous solution of the alkali metal salt of an organic acid is preferably 3 to 70%, and more preferably 5 to 50% of the total volume of water in the solution.

The concentration of the alkali metal salt of the organic acid in the tert-alcohol-containing aqueous solution is 7 to 50%, preferably 7 to 45%, and more preferably 10 to 40% by weight.

The temperature of the tert-alcohol-containing aqueous solution of the alkali metal salt of an organic acid to be added to the reaction vessel is kept preferably at 50 to 90° C., more preferably at 60 to 85° C., and most preferably at 65 to 85° C. in order to prevent the alkali metal salt from crystallization or solidification. Further, to keep the reaction temperature constant, the solution temperature is controlled at a constant value fallen within the preferred range described above.

The organic silver salt to be preferably used in the invention can be prepared either by i) a single addition method comprising adding the tert-alcohol-containing aqueous solution of the alkali metal salt of an organic acid into the aqueous solution of the water-soluble silver salt the total amount of which is charged in the reaction vessel in advance, or by ii) a simultaneous addition method that involves a period in which the aqueous solution of the water-soluble silver salt and the tert-alcohol-containing aqueous solution of the alkali metal salt of an organic acid are added simultaneously into the reaction vessel. Among these, the latter is preferred as it can better control the average grain size of the resulting organic silver salt, thus achieving narrow size distributions. In the latter method, preferably not less than 30% by volume, and more preferably 50 to 75% by volume of the total added amount is injected simultaneously. If either solution is to be added in precession, the solution of the water-soluble silver salt is preferably selected.

In either addition method, the liquid present in the reaction vessel (which means the solution of the water-soluble silver salt precedently added, or the solvent having been charged in the vessel prior to the reactant addition when the solution of the water-soluble silver salt is not added precedently) is kept preferably between 5 and 75° C., more preferably between 5 and 60° C., and most preferably between 10 and 50° C. The temperature of the liquid may preferably be kept constant at a value fallen within the range described above during the whole reaction period, or may preferably be controlled by a number of temperature patterns fallen within the range described above.

The temperature difference between the tert-alcohol-containing aqueous solution of the alkali metal salt of an organic acid and the liquid in the vessel is preferably 20 to 85° C., and more preferably 30 to 80° C. Here, the temperature of the tert-alcohol-containing aqueous solution of the alkali metal salt of the organic acid is preferably higher.

By adopting the method described heretofore, the speed with which the alkali metal salt of an organic acid separates as minute crystals when the hot tert-alcohol-containing aqueous solution thereof is rapidly cooled in the vessel, and the speed of the organic silver salt formation by the reaction with the water-soluble silver salt are favorably controlled, thus forming the organic silver salt having a desirable crystal shape, crystal size and size distribution. At the same time, the capabilities as a photothermographic material, in particular as a photothermographic image-recording material improve.

In the reaction, the reaction vessel may contain a solvent medium prior to the reactant addition. As such a solvent medium, water or mixed solvents with the tert-alcohols described previously are preferably used.

The tert-alcohol-containing aqueous solution of the alkali metal salt of an organic acid, the aqueous solution of a water-soluble silver salt, or the reaction liquid may contain a dispersion aid soluble in aqueous media. Any type of dispersion aid can be used provided that it can well disperse the resulting organic silver salt. Specific examples appear in the description on the dispersion aid for organic silver salts to be shown later.

In the preparation of organic silver salts, it is desirable to subject the salt to desalting and dehydrating operations after grain formation. Any known method can preferably be applied including various filtration methods such as centrifugal, suction, ultrafiltration, flock washing based on flocculation, and centrifugal separation-sedimentation followed by supernatant removal. The desalting and dehydrating operations may be performed once or repeatedly. Water addition and removal may be made continuously or stepwise. The desalting and dehydration are performed in such a manner that the finally removed water has an electric conductivity not exceeding preferably 300 μS/cm, more preferably 100 μS/cm, and most preferably 60 μS/cm. There is no special lower limit for the conductivity, which is usually 5 μS/cm.

Further, to make the surface structure of the coating of the photothermographic material or the photothermographic image-recording material desirable, it is preferred to prepare a very fine dispersion of the organic silver salt by converting the aqueous dispersion thereof once formed to a high-speed stream by means of high pressure, and dispersing it again by subsequent pressure reduction. For such operation, the dispersing medium preferably consists solely of water, but may contain an organic solvent in an amount not exceeding 20% by weight.

Mechanical methods of finely dispersing the organic silver salt include those using any dispersing means well known in the art in the presence of dispersion aid. Such means includes, for example, high-speed mixer, homogenizer, high-speed impact mill, Bambury mixer, homomixer, kneader, ball mill, vibrating ball mill, planet ball mill, attritor, sand mill, bead mill, colloid mill, jet mill, roller mill, thoron mill and high-speed stone mill.

When a photosensitive silver salt is present during the dispersion of the organic silver salt, the fog increases and the sensitivity considerably drops. Thus substantially no photosensitive silver salt is preferably contained during the dispersion of the organic silver salt. The amount of a photosensitive silver salt in the aqueous dispersion does not exceed 0.1 mole % per one mole of the organic silver salt with no intentional incorporation of a photosensitive silver salt.

In order to obtain a homogeneous dispersion of a solid organic silver salt of small grain sizes without aggregation with suppressed fogging, a uniform large force is preferably applied within such an extent that the organic silver salt grain as image-forming element is neither damaged nor heated to an excessively elevated temperature. As a dispersion method meeting such requirements, one comprising converting the aqueous dispersion consisting of the organic silver salt and the aqueous dispersant solution to a high-speed stream and then reducing the pressure is preferred.

The details of dispersing apparatuses and technologies used to practice such a re-dispersing method are given in, e.g., pp. 357 to 403, *Bunsan-kei Reoroji to Bunsan Gijutsu* (*Rheology of Dispersion and Dispersion Technology*), authored by T. Kajiuchi and H. Usui, published by Shinzansha Shuppan Co., Ltd., in 1991, pp. 184 to 185, *Kagaku Kogaku no Shimpo* (*Series of Progress in Chemical Engineering*) Vol. 24, edited by Tokai Chapter, the Society of Chemical Engineers, Japan, published by Maki Shoten Co., Ltd. in 1990, JP-A-59-49832, U.S. Pat. No. 4,533,254, and JP-A-8-137044, JP-A-8-238848, JP-A-2-261525 and JP-A-1-94933. In the invention, a very fine re-dispersion is preferably performed by sending an aqueous dispersion containing at least an organic silver salt into a pipe by applying a pressure with a high pressure pump, passing the dispersion through a fine slit equipped in the pipe, and then generating an abrupt pressure drop in the dispersion.

Generally, a homogeneous, efficient dispersion is considered to proceed in a high pressure homogenizer by making a full use of (a) the shear stress acting on the dispersed phase passing through a narrow gap of 75 to 350 μm width with a high speed under a high pressure, and (b) the impact force generated by the liquid/liquid collision occurring in the highly pressed, narrow space or by the collision of the dispersion against the wall, and further enhancing the cavitation force formed by the subsequent pressure drop. In a Gaulin homogenizer, a famous example of the dispersing apparatus of such type, a mixture to be dispersed which is sent with a high pressure is converted into a high speed stream in a narrow gap formed on a cylindrical surface. Then, the stream collides against the wall by inertia whereby the generated impaction force carries out emulsification and dispersion. A similar liquid/liquid collision takes place in the Y-shaped chamber of a micro fluidizer and a spherical chamber using a spherical check valve described in JP-A-8-103642 to be explained soon. As for liquid/wall collision, the Z-shaped chamber of a micro fluidizer is mentioned. In general, a pressure of 9.8 to 58.8 MPa, a flow rate of several to 30 m/sec is adopted, and in order to increase the dispersion efficiency, various modifications are devised to increase the number of collision by fabricating the high-speed flowing part in the form of saw teeth. Typical examples of such types of apparatus include Gaulin homogenizer, Micro Fluidizer made by Microfluidex International Corp., the micro fluidizer of Mizuho Industrial Co., Ltd. and Nanomizer of Tokushu Kika Kougyo Co., Ltd. Related descriptions are found in JP-A-8-238848 and JP-A-8-103642 and U.S. Pat. No. 4,533,254.

By controlling the flow rate, the difference in pressure during pressure drop and the number of dispersing operation, one can achieve a desired grain size for the organic silver salt. From the viewpoints of photographic characteristics and grain size, the flow rate of 20 to 600 m/sec and the pressure drop of 88.2 to 294 MPa are preferred, but the flow rate of 300 to 600 m/sec and the difference in pressure during pressure drop of 147 to 294 MPa are more preferred. The dispersing operation, which may be appropriately repeated depending on the requirement, is usually done one to ten times, but, by taking into account manufacturing efficiency, 1 to 3 time repetitions are more preferred. To permit the aqueous dispersion to elevate its temperature too much under a high pressure is not desirable from the viewpoints of dispersion and photographic properties, as the grain size tends to increase under an elevated temperature above 90° C. together with the increase of fog density. Accordingly, either of the operation prior to converting the dispersion to a high pressure, high speed stream, or the one after the pressure reduction, or both of them are preferably carried out with the use of a cooling device so as to keep the temperature of the aqueous dispersion in the range of 5 to 90° C., more preferably 5 to 80° C., and particularly preferably 5 to 65° C. Particularly, during the dispersion under a high pressure of from 147 to 294 MPa, cooling is very effective. Suitable cooling devices are selected, depending on the required amount of heat exchange, such as double- or triple-structure tube combined with a static mixer, multipipe heat exchanger, and coiled heat exchanger. To raise heat exchanging efficiency, the diameter, wall thickness and material of the pipes are appropriately selected, taking the pressure to be used into consideration. A suitable coolant may be selected for the cooling device from well water of 20° C., chilled water of 5 to 10° C. treated with a freezer, and, if needed, ethylene glycol/water mixtures of −30° C., depending on the heat amount to be exchanged.

There is no special limitation on the dispersant used in finely dividing the solid organic silver salt, and each of the following compounds, e.g., may be used alone or in combination.

Polyacrylic acid, acrylic acid copolymers, maleic acid copolymers, maleic acid monoester copolymers, acryloylmethylpropanesulfonic acid copolymers, carboxymethyl starch, carboxymethyl cellulose, arginic acid, pectinic acid and the anionic polymers described in JP-A-9-179243;

the known anionic surfactants described in JP-A-52-92716 and W088/04794, and nonionic and cationic surfactants well known in the art;

nonionic polymers such as poly(vinyl alcohol), polyvinylpyrrolidone, hydroxypropyl cellulose and hydroxypropylmethyl cellulose; and polymeric materials of natural origin such as gelatin, casein and glue.

As an ordinary method, dry powder or wet cake of the organic silver salt, to which a dispersion aid has been added prior to dispersing operation, is fed, in the form of slurry, to a dispersing apparatus. Alternatively, however, a mixture containing the organic silver salt and a dispersion aid may be subjected to a heat or solvent treatment to provide a powder blend or a wet cake beforehand. The pH of the mixture may be regulated with an appropriate pH-regulating agent before, after or during the dispersion operation.

Beside mechanical dispersion, a process based on pH control may also be employed in which a crude dispersion prepared under a controlled pH value is subjected to a shift of the pH value in the presence of a dispersion aid to cause finer particle formation. For the crude dispersion in such a process, use can be made of an organic solvent, which is usually removed after the formation of finer particles.

A resulting dispersion can be stored under a constant agitation to prevent the sedimentation of the fine particles, or in a highly viscous state with use of a hydrophilic colloid (e.g., in a gelled state with use of gelatin). Further, for the purpose of preventing the propagation of miscellaneous germs during storage, a preservative may be added.

It is desirable that, after dispersed in an aqueous solvent system, the organic silver salt prepared by any of the methods described hereinabove is mixed with an aqueous dispersion of a photosensitive silver salt to prepare a coating solution for the production of a photosensitive image-forming medium.

Prior to fine dispersion, the raw stock liquid is dispersed coarsely (i.e., subjected to preliminary dispersion). Means usable for the coarse dispersion include various known devices (e.g., high-speed mixer, homogenizer, high-speed impact mill, Bambury mixer, homomixer, kneader, ball mill, vibrational ball mill, planet-type ball mill, attritor, sand mill, beads mill, colloid mill, jet mill, roller mill, thoron mill or high-speed stone mill). In addition to mechanical dispersion, a process based on pH control may also be employed in which a crude dispersion in a solvent prepared under a controlled pH value is subjected to a shift of the pH value in the presence of a dispersion aid to cause finer particle formation. For the crude dispersion in such a process, use can be made of an organic solvent, which is usually removed after the formation of finer particles.

An aqueous dispersion of a photosensitive silver salt is finely dispersed and then added to the organic silver salt dispersion to provide a coating solution for the preparation of a photosensitive image-forming media. A photothermographic image-recording material prepared with such a coating solution has advantages of a low haze, a low fog and a high sensitivity. In contrast, if a photosensitive silver salt is present during the dispersion conducted by converting to a high pressure, high speed stream, the resulting image-recording material shows an increased fog as well as a noticeable sensitivity drop. When an organic solvent instead of water is used as dispersion medium, not only increased haze and fog result but the sensitivity tends to fall. On the other hand, when the so-called conversion technique is adopted whereby part of the organic silver salt in the dispersion is converted to a photosensitive silver salt, instead of mixing an aqueous dispersion of a photosensitive silver salt, the sensitivity decreases.

In the process described above, the aqueous dispersion subjected to the dispersion operation based on the conversion of a high-pressure, high-speed stream substantially contains no photosensitive silver salt, the content of the photosensitive silver salt not exceeding 0.1 mole % relative to mole photo-insensitive organic silver salt as a result of no intentional addition of a photosensitive silver salt.

The particle size (the volume-weighted average diameter) of the organic silver salt in the form of finely divided solid dispersion can be obtained by, e.g., irradiating laser light to the organic silver salt dispersed in a liquid medium, and deriving the auto-correlation function for the temporal change in the fluctuation of the light scattered by the dispersion. Finely divided solid dispersions having an average particle size of from 0.05 to 10.0 μm are preferred, those having an average particle size of from 0.1 to 5.0 μm are more preferred, still more preferably the particle size being from 0.1 to 2.0 μm.

The finely divided solid dispersion of an organic silver salt to be preferably used in the invention comprises at least an organic silver salt and water. Though the ratio between the amount of the organic silver salt and that of water is not specifically limited, the organic silver salt preferably occupies 5 to 50% by weight, more preferably 10 to 30% by weight of the total amount. Although the dispersion aid described previously may be preferably used, the amount thereof is preferably as small as possible within the range suited for minimizing the particle size. Specifically, the use amount of the dispersant is preferably from 1 to 30% by weight, more preferably from 3 to 15% by weight relative to the amount of the organic silver salt.

In the invention, a photosensitive material can be prepared by mixing the aqueous dispersion of an organic silver salt with the aqueous dispersion of a photosensitive silver salt whereby the mixing ratio of the organic silver salt to the photosensitive silver salt can be selected depending on purposes. The ratio of the photosensitive silver salt to the organic silver salt is preferably from 1 to 30 mole %, more preferably from 3 to 20 mole %, and particularly preferably from 5 to 15 mole %. It is often preferably practiced, in order to control the photographic characteristics, to use two or more kinds of aqueous organic silver salt dispersions with two or more kinds of aqueous photosensitive silver salt dispersions in such mixing operation.

The use amount of the organic silver salt in the invention may vary according to needs, and generally is preferably from 0.1 to 5 g/m$^2$, more preferably from 1 to 3 g/m$^2$.

In the invention, an image contrast enhancer, i.e., so-called nucleating agent may be used to obtain high contrast images. The nucleating agents applicable to the invention are not specially limited at all, some preferable examples thereof being as follows: every hydrazine derivative described in JP-A-10-10672, JP-A-10-161270, JP-A-10-62898, JP-A-9-304870, JP-A-9-304872, JP-A-9-304871, and JP-A-10-31282, U.S. Pat. No. 5,496,695 and EP-A-741320. The hydrazine derivatives represented by formula (H) described in JP-A-2000-284399, specifically those enumerated in Tables 1 to 4 of this patent specification are preferably used, too.

Moreover, the substituted alkene derivatives, substituted isoxazole derivatives, specified acetal compounds represented by formulae (1) to (3) described in JP-A-2000-284399, and, in particular, the cyclic compounds represented by formulae (A) or (B) given in the same specification (specific compounds being Compounds 1 to 72 given in Ka 8 to Ka 12) are preferably used.

Arbitrary combinations of two or more of those nucleating agents may be selected for use.

The above-described nucleating agent can be used in the form of a solution in water or a suitable organic solvent such as alcohol (methanol, ethanol, propanol or fluorinated alcohol), ketone (acetone or methyl ethyl ketone), dimethylformamide, dimethylsulfoxide or methyl cellosolve.

The nucleating agent may be used also in the form of emulsified dispersion prepared by any of the well known emulsifying processes with use of an oil such as dibutyl phthalate, tricresyl phosphate, glycelyl triacetate or diethyl phthalate, or an auxiliary solvent such as ethyl acetate or cyclohexanone. Further, by the known solid dispersion processes, the powder of a nucleating agent may be used which has been dispersed in a suitable solvent such as water by suitable means including ball mill, colloid mill or ultrasonic wave energy.

The nucleating agent may be incorporated in any layer including the image-forming layer mentioned hereinabove that is provided on the image-forming layer side of the support, but preferably contained in the image-forming layer or the layer contiguous to the image-forming layer.

The added amount of the nucleating agent is preferably from $1\times10^{-6}$ to 1 mole, more preferably from $1\times10^{-5}$ to $5\times10^{-1}$ mole, and most preferably from $2\times10^{-5}$ to $2\times10^{-1}$ mole per mole silver.

In addition to the compounds mentioned above, those given in U.S. Pat. Nos. 5,545,515, 5,635,339 and 5,654,130, WO97/34,196, U.S. Pat. No. 5,686,228, and further, those given in JP-A-11-119372, JP-A-11-109546, JP-A-11-119373, JP-A-11-133546, JP-A-11-95365 and JP-A-11-95366 may also be used.

In the invention, a contrast-enhancing promoter can be used together with the nucleating agent described above in order to provide ultra high contrast images. Examples of the contrast-enhancing promoter include the amine compounds given in U.S. Pat. No. 5,545,505, specifically compounds AM-1 to AM-5 therein, the hydroxamic acids given in U.S. Pat. No. 5,545,507, specifically compounds HA-1 to HA-11 therein, the acrylonitriles given in U.S. Pat. No. 5,545,507, specifically compounds CN-1 to CN-13 therein, the hydrazine compounds given in U.S. Pat. No. 5,558,983, specifically compounds CA-1 to CA-6 therein, the onium salts given in JP-A-9-297368, specifically compounds A-1 to A-42, B-1 to B-27 and C-1 to C-14 therein.

In the photothermographic image-recording material comprising a photo-insensitive silver salt, a photosensitive silver halide and a binder, formic acid or the salt thereof acts as a strong fogging agent. In the photothermographic image-recording material of the invention, the content of formic acid or the salt thereof incorporated in the layers provided on the side having the image-forming layer containing the photosensitive silver halide preferably does not exceed 5 millimole, more preferably 1 millimole per mole silver.

In the photothermographic image-recording material, an acid resulting from the hydration of $P_2O_5$ or the salt thereof is preferably incorporated in combination with a nucleating agent. The acids resulting from the hydration of $P_2O_5$ and the salts thereof include metaphosphoric acid, pyrophosphoric acid, orthophosphoric acid, triphosphoric acid, tetraphosphoric acid and hexametaphosphoric acid and salts of any of these acids. Particularly preferred examples of the acid resulting from the hydration of $P_2O_5$ and the salts thereof are orthophosphoric acid and hexametaphosphoric acid, and their salts. Specific examples of the salts are, e.g., sodium orthophosphate, sodium dihydrogen orthophosphate, and sodium or ammonium hexametaphosphate.

The acid resulting from the hydration of $P_2O_5$ and the salt thereof is preferably incorporated into the image-forming layer or the binder layer contiguous thereto from the standpoint of efficient exertion of the desired effect with a small quantity.

The use amount of the above-described compound derived from $P_2O_5$ is determined by various characteristics such as sensitivity, fog level, etc., and is preferably from 0.1 to 500 mg, and more preferably 0.5 to 100 mg per 1 m$^2$ of the image-forming material.

The photosensitive silver halide used in the invention has no restriction on the halogen composition, thus including silver chloride, silver chlorobromide, silver bromide, silver iodobromide and silver chloroiodobromide. The distribution of the halogen in each grain may be uniform or change stepwise or continuously. Silver halide grains having a core/shell structure can be preferably used. Examples of preferable grain structure include double to fivefold structures; more preferably double to fourfold core/shell structured grains can be used. Further, techniques with which a silver bromide phase is localized on the surface of silver chloride or silver chlorobromide grains are preferably employed.

The preparation of photosensitive silver halides is well known in the photographic field, and the preparation processes given, e.g., in RD-17029 disclosed in June 1978 and U.S. Pat. No. 3,700,458 can be used. Specifically, by adding a silver ion source compound and a halogen ion source compound into a solution of gelatin or other polymers, a photosensitive silver halide is prepared, which is then mixed with an organic silver salt.

The particle size of the photosensitive silver halide is preferably up to 0.20 μm, more preferably from 0.01 to 0.15 μm, still more preferably from 0.02 to 0.12 μm to suppress the white turbidity after image formation. The particle size herein means the diameter of the sphere having the same volume as the silver halide grain in concern for normal crystals such as cubic or octahedral and for those other than normal ones such as, e.g., spherical or rod-shaped crystals. On the other hand, when the silver halide grains are tabular, the particle size means the diameter of a circle having the area equal to that of the projected area of the main plane of the grain.

Silver halide grains can take various grain shapes including cubic, octahedral, tabular, spherical, rod-like or pebble-like ones, among which cubic grains are especially preferably used. Grains having rounded corners can also be employed. Though there is no special restriction on the plane indices (Miller indices) of the outer surfaces of the photosensitive silver halide grain, it is preferred from the viewpoint of a high spectral sensitization efficiency for adsorbed spectral sensitizers to use grains having the [001] plane at a large ratio. The ratio is preferably not lower than 50%, more preferably 65% or more, and still more preferably 80% or more. The ratio of the planes of [100] Miller index can be measured by the method described by T. Tani in J. Imaging Sci., 29, (1985) utilizing the dependence of the adsorptive property for sensitizing dyes between the [111] and [100] planes.

The photosensitive silver halide grains for use in the invention contains a metal belonging to the 8th to 10th groups of the periodic table (comprising the first to 18th groups) or a complex thereof. Preferable metals belonging to the 8th to 10th groups or as the core of the complex are rhodium, rhenium, ruthenium, osmium and iridium. One or more metal complexes may be used in combination whereby the same or different metals may be contained in the complexes. A preferable content thereof is from $1\times10^{-9}$ to $1\times10^{-3}$ mole per mole silver. Useful complexes are described in paragraph Nos. 0018 to 0024 of JP-A-11-65021.

In practicing the invention, an iridium compound is especially preferably incorporated in silver halide grains. Usable iridium compounds include, e.g., hexachloroiridium, hexaammineiridium, trioxalateiridium, hexacyanoiridium, pentachloronitrosyliridium. Such an iridium compound is used in the form of solution in water or a suitable solvent. Further, the method of stabilizing the iridium compound solution well known in the art comprising the addition of a hydrogen halide aqueous solution (e.g., hydrochloric acid, hydrobromic acid or hydrofluoric acid), or an alkali halide (e.g., KCl, NaCl, KBr or NaBr) can also be employed. Instead of using a water-soluble iridium compound, silver halide grains that have been prepared separately and doped with iridium beforehand may be added for dissolution during the preparation of silver halide grains. The added amount of such an iridium compound preferably is in the range of from $1\times10^{-8}$ to $1\times10^{-3}$ mole per mole silver halide, and more preferably from $1\times10^{-7}$ to $5\times10^{-4}$ mole per mole silver halide.

Metal atoms (e.g., $[Fe(CN)_6]^{4-}$) that can be incorporated in the silver halide grains for use in the invention, desalting and chemical sensitization methods applicable to the invention are described in JP-A-11-84574, paragraph Nos. 0046 to 0050, and JP-A-11-65021, paragraph Nos. 0025 to 0031.

Spectral sensitizers used in the invention are those capable of spectrally sensitizing silver halide grains at a desired wavelength range when they are adsorbed on silver halide grains. One can select a spectral sensitizer suited for the spectral characteristics of the light source used to expose the resulting image-recording material. As for the spectral sensitizer and the addition method thereof, reference can be made to JP-A-11-65021, paragraph Nos. 0103 to 0109, the compounds represented by formula (II) of JP-A-10-186572, and EP-A-0803764, from p. 19, line 38 to p. 20, line 35. In the invention, the time when a sensitizing dye is added to the silver halide emulsion preferably is in the period from the completion of desalting to before coating, and more preferably from the completion of desalting to the initiation of chemical ripening.

Silver halide grains for use in the invention are preferably chemically sensitized by sulfur, selenium or tellurium sensitization. Examples of the compound preferably used in sulfur, selenium and tellurium sensitization for the invention include various compounds well known in the art such as those described in, e.g., JP-A-7-128768. Among the three sensitizations, tellurium sensitization is particularly useful for the invention. Tellurium sensitizing agents include, e.g., diacyl tellurides, bis(oxycarboyl) tellurides, bis(carbamoyl) tellurides, diacyl ditellurides, bis(oxycarboyl) ditellurides, bis(carbamoyl) ditellurides, compounds containing a P=Te bond, tellurocarboxylic acid salts, tellurosulfonates, compounds containing a P-Te bond or tellurocarbonyl compounds. Specifically, the compounds given in the references cited in JP-A-11-65021, paragraph No. 0030 are used. In particular, the compounds represented by formulae (II), (III) and (IV) of JP-A-5-313284 are preferably used.

In the invention, chemical sensitization that may be conducted at any time in the period from the completion of grain formation to the start of coating can be performed specifically after desalting, (1) prior to, (2) simultaneously with, or (3) after spectral sensitization, or (4) immediately before coating. To carry out chemical sensitization after spectral sensitization is particularly preferred.

The amount of the sulfur, selenium or tellurium sensitizer used in the invention, which depends on the type of silver halide grains as well as chemical ripening conditions, is from $10^{-8}$ to $10^{-2}$ mole, preferably from $10^{-7}$ to $10^{-3}$ mole per mole silver halide. The conditions for chemical sensitization conducted for the invention have no special limitations, and a pH value of from 5 to 8, a pAg value of from 6 to 11, preferably from 7 to 10, and a temperature of from 40 to 95° C., preferably from 44 to 70° C. are usually adopted.

The photosensitive silver halide emulsion for use in the photosensitive material for the invention may comprise one kind of emulsion or two or more (each differing in, e.g., average grain size, halogen composition, crystal habit or chemical sensitization condition) in combination. The gradation can be regulated by using a plurality of photosensitive silver halides each having a different sensitivity. Techniques related to such regulations are given in JP-A-57-119341, JP-A-53-106125, JP-A-47-3929, JP-A-48-55730, JP-A-46-5187, JP-A-50-73627, and JP-A-57-150841. The sensitivity difference between the emulsions to be used together is preferably not less than 0.2 log E whereby E implies illuminance.

The amount of the photosensitive silver halide is preferably, in terms of the coated amount of silver per 1 $m^2$ of the photosensitive material, from 0.03 to 0.6 $g/m^2$, more preferably from 0.05 to 0.4 $g/m^2$, still more preferably from 0.1 to 0.4 $g/m^2$, while, relative to 1 mole of the organic silver salt, the photosensitive silver halide is used preferably from 0.01 to 0.5 mole, more preferably from 0.02 to 0.3, still more preferably 0.03 to 0.25 mole.

As for the mixing method and conditions with which a photosensitive silver halide and an organic silver salt each having been prepared independently are mixed together, there is no special limitation provided that the advantageous features of the invention are fully achieved. Specifically, apparatus including a high-speed mixer, ball mill, sand mill, colloid mill, vibrating mill or homogenizer can be used to blend the silver halide grains with the organic silver salt each having been perfectly prepared. Alternatively, at any time during the preparation of the organic silver salt, the finished photosensitive silver halide may be blended with the organic silver salt and then the organic silver salt may be perfectly prepared.

An ordinary timing of introducing the silver halide into the coating solution for the image-forming layer is from 180 to substantially 0 minute before coating, and preferably from 60 minutes to 10 seconds before coating. As for the method and condition for such introduction, there is no special limitation so long as they do not hinder the achievement of the advantageous effects of the invention. Specific mixing methods include one based on mixing in a tank in such a manner that an average staying period calculated from the addition flow rate and the rate of liquid feeding to the coater is fallen within a desirable period, and one using a static mixer as described in *Ekitai Kongo Gijutsu* (*Liquid Mixing Techniques*), authored by N. Harnby, M. F. Edwards and A. W. Nienow, translated by Koji Takahashi (Nikkan Kogyo Shinbun-sha, 1989), Chapter 8.

The photothermographic image-recording material of the invention can contain a mercapto, disulfide or thione compound for the purposes of controlling developing activity either by development suppression or promotion, enhancing spectral sensitization efficiency and storability before and after development. Examples of preferable compounds include those given in JP-A-10-62899, paragraph Nos. 0067 to 0069 and those represented by formula (I) of JP-A-10-186572 in which specific compounds are shown in paragraph Nos. 0033 to 0052 and EP-A-0803764, p. 20, lines 36 to 56. Among these compounds, mercapto-substituted heteroaromatic compounds are preferred.

In the photothermographic image-recording material of the invention, an agent for controlling the tone is preferably incorporated. Preferable agents for controlling the tone are detailed in JP-A-10-62899, paragraph Nos. 0054 to 0055, and EP-A-0803764, p. 21, lines 23 to 48. Particularly preferable compounds include phthalazinone, the derivatives and metal salts thereof such as 4-(1-naphthyl)phthalazinone, 6-chlorophthalazinone, 5,7-dimethoxyphthalazinone or 2,3-dihydro-1,4-phthalazinedione; combinations of phthalazinone and a phthalic acid derivative (e.g., phthalic acid, 4-methylphthalic acid, 4-nitrophthalic acid and tetrachlorophthalic anhydride); phthalazines (phthalazine, the derivatives and metal salts thereof such as 4-(1-naphthyl)phthalazine, 6-isopropylphthalazine, 6-tert-butylphthalazine, 6-chlorophthalazine, 5,7-dimethoxyphthalazine and 2,3-dihydrophthalazine); combinations of a phthalazine compound and a phthalic acid derivative (e.g., phthalic acid, 4-methylphthalic acid, 4-nitrophthalic acid and tetrachlorophthalic anhydride). Among these, combinations of a phthalazine compound with a phthalic acid derivative are particularly preferred.

Plasticizers and lubricants usable in the photosensitive layer of the photothermographic image-recording material of the invention are given in JP-A-11-65021, paragraph No. 0117 while ultra-high contrast enhancers used to develop ultra-high contrast images are given in the same specification, paragraph No. 0118, and represented by formulae (III) to (V) in JP-A-2000-347345 (specific compounds: Ka 21 to Ka 24). Further, contrast enhancing promoters are described in JP-A-11-65021, paragraph No. 0102.

The photothermographic image-recording material of the invention may be provided with a surface protective layer with the purpose of adhesion prevention of the image-forming layer.

Binders used in the surface protective layer have no special limitation and may comprise any ordinary polymer material with film-forming capability. Water-soluble polymers or oil-soluble polymers can be used in the forms of aqueous solution, aqueous dispersion or organic solvent solution. Examples of usable materials are given in, e.g., JP-A-11-65021.

Preferable water-soluble polymer materials include, e.g., gelatin, poly(vinyl alcohol) (PVA). Preferable types of PVA include completely saponified PVA (e.g., PVA-105, a commercially available product from Kuraray Co., Ltd.), partially saponified PVA (e.g., PVA-205, a commercially available product from Kuraray Co., Ltd.), and modified PVA (e.g., MP-102 or MP-203, commercially available products from Kuraray Co., Ltd.). The coated amount of the water-soluble binder per one protective layer is preferably from 0.3 to 4.0 $g/m^2$, especially preferably from 0.3 to 2.0 $g/m^2$.

The preparation temperature of the coating solution for the image-forming layer is preferably controlled between 30° C. and 65° C., more preferably between 35° C. and less than 60° C., still more preferably between 35° C. and 55° C. It is desirable to keep the temperature of the coating solution for the image-forming layer just after the addition of a polymer latex to 30–65° C. It is further desirable that, prior to the addition of the polymer latex, the mixing of the reducing agent and the organic silver salt have completed.

The pH of the coating solution for the image-forming layer is preferably adjusted within a range of from 3.0 to 8.0, more preferably from 4.0 to 8.0, especially preferably from 5.0 to 8.0.

The liquid containing the organic silver salt or the coating solution for the image-forming layer of the photothermographic image-recording material of the invention is preferably thixotropic. The term thixotropy means a property of a fluid exhibiting viscosity decrease along with the increase of shear velocity. The viscosity of a fluid can be measured with a variety of devices, among which RFS Fluid Spectrometer manufactured by Rheometric Science, Far East, Ltd. is preferably used at 25° C. The liquid containing the organic silver salt or the coating solution for the image-forming layer of the photothermographic image-recording material of the invention preferably has a viscosity at 0.1 $s^{-1}$ shear velocity of from 400 to 100,000 mPa·s, and more preferably 500 to 20,000 mPa·s, while, at 1000 $s^{-1}$ shear velocity, the viscosity is preferably 1 to 200 mPa·s, more preferably 5 to 80 mPa·s.

Various systems showing thixotropy are known as described in, e.g., *Koza Reoroji* (*Lecture Series: Rheology*), edited by Kobunshi Kankokai, *Kobunshi Ratekkusu* (*Poly-*

*mer Latex*) authored by Muroi and Morino (published by Kobunshi Kankokai). For a fluid to exhibit thixotropy, the fluid needs to contain finely divided solid particles at a high content. To enhance thixotropy, it is effective to use a viscosity-increasing linear polymeric material, increase the aspect ratio of the solid particles contained in the fluid, raise the viscosity with an alkali, or use a surfactant.

The heat-developable photographic emulsion for use in the invention comprises one or more layers provided on a support. A mono-layer structure must contain therein an organic silver salt, a silver halide, a developer, a binder and optional additives including agent for controlling the tone, coating aid, etc. depending needs. In a dual-layer structure, a first layer (usually contiguous to the support) must contain an organic silver salt and a silver halide, and a second layer or both layers must contain the remaining ingredients. Alternatively, another dual-layer structure is possible whereby a single emulsion layer containing all the essential ingredients is covered with a surface protective layer. A multicolor-photosensitive heat-developable photographic material may comprise two layers for each color, or may contain all the ingredients in a single layer as described in U.S. Pat. No. 4,708,928. In a heat-developable photographic material that uses plural dyes and is sensitive to plural colors, each emulsion layer is separated from each other with use of a functional or non-functional barrier layer therebetween as described in U.S. Pat. No. 4,460,681.

The photosensitive layer of the photothermographic image-recording material of the invention can contain a dye or pigment for the purposes of improving the tone of the recorded image, preventing streaks caused by the interference occurring at laser exposure and irradiation. Related techniques are described in detail in W098/36322. Preferable dyes and pigments used in the photosensitive layer include anthraquinone dyes, azomethine dyes, indaniline dyes, azo dyes, indanthlone pigments belonging to the anthraquinone group (e.g., C.I. Pigment Blue 60), phthalocyanine pigments (e.g., cupper phthalocyanine identified as C.I. Pigment Blue 15, or metal-free phthalocyanine as C.I. Pigment Blue 16), triarylcarbonyl pigments belonging to the mordant lake pigment group, indigo and inorganic pigments (e.g., ultramarine and cobalt blue). Such dye or pigment may be added in any form including solution, emulsion, solid dispersion or a mordanted state with a polymer mordant. The use amount of the compound which is determined by the degree of light absorption therewith preferably is in the range of from 1 μg to 1 g per $m^2$ of the photosensitive material.

In the invention, an antihalation layer can be provided in the far side from an exposure light source relative to the photosensitive layer. As for the antihalation layer, descriptions are given in JP-A-11-65021, paragraph Nos. 0123 to 0124.

In the invention, it is preferred to incorporate a decolorizable dye and a base precursor into a photo-insensitive layer of the photothermographic image-recording material whereby the photo-insensitive layer acts as a filter or an antihaltion layer. Generally, a photothermographic image-recording material contains a photo-insensitive layer in addition to a photosensitive one. Such a photo-insensitive layer can be classified into (1) a protective layer provided above the photosensitive layer (in other words, at a far side from the support), (2) an interlayer provided between a plurality of photosensitive layers, or between the protective layer and the photosensitive layer, (3) a subbing layer provided between the photosensitive layer and the support, and (4) a back layer provided on the side of the support opposite to the photosensitive layer side. A filter layer is formed in the photosensitive material as one belonging to (1) or (2) above, while an antihalation layer belongs to (3) or (4).

The decolorizable dye and a base precursor is preferably incorporated in the same photo-insensitive layer. But they may be incorporated separately in two contiguous photo-insensitive layers. Further, between the two contiguous photo-insensitive layers, there may be provided a barrier layer.

The decolorizable dye may be incorporated in a photo-insensitive layer in the form of solution, emulsion or fine solid dispersion. Alternatively, the dye impregnated in a polymer may be added in the coating solution for the photo-insensitive layer. Such a dye may be incorporated in a photo-insensitive layer with use of a polymer mordant. These incorporation methods are common to those employed to incorporate a dye in an ordinary photothermographic image-recording material. Descriptions on the latices used to prepare a dye-impregnated polymer are given in U.S. Pat. No. 4,199,363, West German Patent Laid-Open Nos. 2541274 and 2541230, EP-A-029104, and JP-B-53-41091. The emulsification method with which a dye is added in a solution containing a dissolved polymer is given in W088/00723.

The use amount of the decolorizable dye is determined depending on the purpose of dye usage. In general, the decolorizable dye is used in such an amount as to give an optical density (absorbance) exceeding 0.1 at the wavelength in concern. More preferably, the optical density is from 0.2 to 2. The amount of dye to obtain such an optical density is usually 0.001 to 1 g/$m^2$, and preferably 0.01 to 0.2 g/$m^2$.

Such a decolorizable dye can be decolorized to have an optical density of 0.1 or lower. Two or more kinds of decolorizable dyes may be used together in thermally decolorizable recording materials or photothermographic image-recording materials. Similarly, two or more kinds of base precursors may be used together.

The photothermographic image-recording material of the invention is preferably of a single side type, comprising at least one photosensitive layer containing a silver halide emulsion on one side of the support, and a back layer on the other side of the support.

In the invention, a matting agent is preferably incorporated for the purpose of improving transporting property. As for matting agents, descriptions are given in JP-A-11-65021, paragraph Nos. 0126 to 0127. In terms of coated amount per 1 $m^2$ of photosensitive layer, the matting agent is used preferably of from 1 to 400 mg/$m^2$, more preferably from 5 to 300 mg/$m^2$.

Although the matte degree of the emulsion surface is arbitrarily designed provided that the so-called stardust defect does not occur, a Bekk second between 30 and 2000 sec is preferred, and that between 40 and 1500 sec is more preferred for the emulsion surface.

In the invention, as the matte degree of the back layer, the back layer preferably has a Bekk second of 10 to 1200 sec, more preferably of 20 to 800 sec, especially preferably of 40 to 500 sec.

In the invention, the matting agent is preferably incorporated in the outermost surface layer, a layer that will act as the outermost surface layer, a layer that is close to the outer surface or a layer acting as the so-called protective layer.

The back layers applicable to the invention are described in JP-A-11-65021, paragraph Nos. 0128 to 0130.

A hardener may be used in each of the photosensitive, protective and back layers composing the photothermographic image-recording material of the invention. Examples of the hardener are described in pp. 77 to 87 of *THE THEORY OF THE PHOTOGRAPHIC PROCESS, FOURTH EDITION,* authored by T. H. James (published by Macmillan Publishing Co., Inc., 1977), and include the polyvalent metal ions described in p. 78 of the book described above, the polyisocyanates given in U.S. Pat. No. 4,281,060, and JP-A-6-208193, the epoxy compounds given in U.S. Pat. No. 4,791,042 and the vinylsulfone compounds given in JP-A-62-89048.

The hardener is added in the form of solution; the timing of adding the hardener solution into the coating solution for the protective layer is from 180 to substantially 0 minute before coating, and preferably from 60 minutes to 10 seconds before coating. As for the method and condition for such addition, there is no special limitation so long as they do not hinder the achievement of the advantageous effects of the invention. Specific mixing methods include one based on mixing in a tank in such a manner that an average staying period calculated from the addition flow rate and the rate of liquid feeding to the coater is fallen within a desirable period, and one using a static mixer as described in *Ekitai Kongo Gijutsu* (*Liquid Mixing Techniques*), authored by N. Harnby, M. F. Edwards and A. W. Nienow, translated by Koji Takahashi (Nikkan Kogyo Shinbun-sha, 1989), Chapter 8.

Surfactants usable in the invention are described in JP-A-11-65021, paragraph No. 0132. In the same specification, paragraph No. 0133 describes usable solvents, paragraph No. 0134 describes supports, paragraph No. 0135 describes static prevention or a conductive coating, and paragraph No. 0136 describes the process of recording color images.

A transparent support may be made colored with a blue dye (e.g., dye-1 in the example of JP-A-8-240877) or colorless. Subbing techniques of the support are given in, e.g., JP-A-11-84574 and JP-A-10-186565. As for the antistatic or subbing layer, the techniques given in, e.g., JP-A-56-143430, JP-A-56-143431, JP-A-58-62646 and JP-A-56-120519 may be employed.

The photothermographic image-recording material of the invention preferably takes a mono-sheet form in which an image is formed in the photothermographic image-recording material itself without using any other sheet material such as an image-receiving sheet.

The photothermographic image-recording material of the invention can further contain an antioxidant, stabilizer, plasticizer, UV absorber or coating aid. Each of these additives can be incorporated into the photosensitive or photo-insensitive layers. As regards to related techniques, reference can be made to, e.g., W098/36322, EP-A-803764, JP-A-10-186567 and JP-A-10-18568, respectively.

The photothermographic image-recording material of the invention can be prepared with use of any coating method. Specifically, extrusion coating, slide coating, curtain coating, impregnation coating, knife coating, flow coating or the coating based on the extrusion with the hoppers described in U.S. Pat. No. 2,681,294 may be employed. Further, the extrusion coating given *LIQUID FILM COATING* authored by Stephen F. Kistler and Petert M. Schweizer (CCHAPMAN & HALL, 1997), pp. 399 to 536, or slide coating are preferably employed. Especially preferred is slide coating. An example of the structure of the slide coater is given as FIG. 11*b*.1 at p. 427 of the book described above. If desired and necessary, the coating methods described in pp. 399 to 536 of the book described above, U.S. Pat. No. 2,761,791 and British Patent 837,095 can also be employed to conduct a simultaneous coating of two or more layers.

Techniques that can be applied to the photothermographic image-recording material of the invention are given in EP-A-803764 and EP-A-883022, W098/36322, and JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-125880, JP-A-11-129629, JP-A-11-133536 to JP-A-11-133539, JP-A-11-133542 and JP-A-11-133543.

The photothermographic image-recording material of the invention can be developed with an arbitrary method, but typically after an imagewise exposure, the material is heated to an elevated temperature for heat development. The preferable development temperature is from 80 to 250° C., more preferably from 100 to 140° C. The development period is preferably from 1 to 180 sec, more preferably 10 to 90 sec, especially preferably 10 to 40 sec.

A preferable heat developing method is one using a plate heater. A preferable heat development using a plate heater is described in JP-A-11-133572. The heat developing apparatus disclosed in the specification develops a visible image by bringing a photothermographic image-recording material in which a latent image has been formed into contact with a heating means equipped in the heat developing part thereof. The apparatus comprises a plate heater as the aforementioned heating means, and plural suppressing rollers arranged along one side of the plate heater, and is characterized by that the photothermographic image-recording material is passed between each suppressing roller and the plate heater to cause heat development. It is preferred to divide the plate heater into 2 to 6 sections, and keep the leading section at a temperature about 1 to 10° C. lower than that of the other sections. Such temperature regulation method, which is described also in JP-A-54-30032, not only allows the moisture or organic solvent involved in the photothermographic image-recording material to evaporate therefrom, but also prevents the support of the photothermographic image-recording material from distortion caused by abrupt heating.

Though the photothermographic image-recording material of the invention may be exposed in a variety of ways, it is preferred to use laser as exposure light source. Suitable laser-emitting devices include gas lasers (Ar+ or He-Ne), YAG laser, dye lasers and semiconductor lasers. Moreover, a semiconductor laser can be used in combination with a second harmonic wave-generating element. Among these, gas lasers and semiconductor lasers emitting red to infrared light are preferred.

Laser light in single mode can be utilized whereby the techniques described in JP-A-11-65021, paragraph 0140 can be adopted.

Laser output power is preferably 1 mW or higher, more preferably 10 mW or higher, and especially preferably 40 mW or higher. Plural lasers may be combined. The spot diameter of the laser beam is regulated to about 30 to 200 μm in terms of the $1/e^2$ spot size assuming a Gaussian beam.

A commercially available laser imager equipped with an exposure part and heat developing part is exemplified by Fuji Medical Dry Laser Imager FM-DP L.

The photothermographic image-recording material of the invention is preferably used for medical diagnosis, industrial photography, graphic arts applications and COM recording by forming black-and-white silver images. In such applications, though needless to say, the resulting black-and-white image is further used for duplication with a duplication film for medical diagnosis MI-Dup manufactured by Fuji Photo Film Co., Ltd., and as a mask for image formation with a graphic arts contact exposure film such as DO-175 or PDP-100 manufactured by Fuji Photo Film Co., Ltd. or with an offset printing plate.

The invention has made it possible to provide a photothermographic image-recording material with an improved coating behavior as well as storability before use.

The advantageous features of the invention will be explained more in detail with reference to examples and a comparative example. The materials, use amounts, compositions, process details, process orders, etc., can be appropriately modified within the scope of the invention. Accordingly the scope of the invention is not construed as restricted by the following examples.

Example 1

(Preparation of PET Support)

By using terephthalic acid and ethylene glycol, poly (ethylene terephthalate) (PET) having an intrinsic viscosity (IV) of 0.66 (measured with a solvent comprising phenol and tetrachloroethane (6/4 in weight ratio) at 25° C.) was synthesized according to a conventional process. After pelletized, the PET was dried at 130° C. for 4 hours, then melted at 300° C. and extruded from a T-shaped die. After extrusion, the polymer was rapidly cooled to give a non-stretched film having a thickness of 175 μm after thermal fixation.

The film was stretched to 3.3 time length along the machine direction by means of a pair of rolls each rotating at a different peripheral speed, then expanded 4.5 times along the transverse direction by means of a tenter. These two operations were carried out at 110 and 130° C., respectively. Subsequently, the film was subjected to thermal fixation at 240° C. for 20 sec. and then relaxed by 4% along the transverse direction at the same temperature. Then, after the portion fastened by the tenter was cut off, the film was subjected to knurling at both edges, and wound with 4 kg/cm$^2$. A roll of the 175 μm thick PET support film resulted.

(Surface Corona Processing)

By using a solid-state corona processor Model 6KVA, a product of Pillar Co., Ltd., both surfaces of the support were processed at a rate of 20 m/min. By reading the current and voltage values during the processing, it was confirmed that the support accepted a treatment of 0.375 kV·A·min/m$^2$. The processing frequency was 9.6 kHz and the gap between the electrode and the dielectric roll was 1.6 mm.

(Preparation of sub-coated support)

(1) Preparation of coating solution for subbing layer

| Formulation 1 (for subbing the surface on which the image-forming layer is provided) | |
|---|---|
| PES Resin A-515GB (30% by weight solution, a product of Takamatsu Oil and Fat Co., Ltd.) | 234 g |

-continued

| | |
|---|---|
| Poly(ethylene glycol) monononylphenyl ether (average ethylene oxide mole number = 8.5) 10% by weight solution | 21.5 g |
| MP-1000 (polymer fine particles with an average diameter of 0.4 μm, a product of Soken chemical & Engineering Co., Ltd.) | 0.91 g |
| Distilled water | 744 ml |
| **Formulation 2 (for the first layer on the back surface)** | |
| Butadiene-styrene copolymer latex (solid content: 40% by weight, butadiene/styrene weight ratio = 32/68) | 158 g |
| 2,4-Dichloro-6-hydroxy-S-triazine sodium salt, 8% by weight aqueous solution | 20 g |
| Sodium laurylbenzenesulfonate, 1% by weight aquous solution | 10 ml |
| Distilled water | 854 ml |
| **Formulation 3 (for the second layer on the back surface)** | |
| $SnO_2$/SbO (9/1 in weight ratio, average particle size: 0.038 μm, 17% by weight dispersion) | 84 g |
| Gelatin (10% by weight aqueous solution) | 89.2 g |
| Metrose TC-5 of Shin-etsu Chemical Co., Ltd. (2% by weight aqueous solution) | 8.6 g |
| MP-1000 of Soken Chemical & Engineering Co., Ltd (polymer fine particle) | 0.01 g |
| Sodium dodecylbenzenesulfonate, 1% by weight aqueous solution | 10 ml |
| NaOH (1 weight/volume %) | 6 ml |
| Proxel (a product of ICI, Ltd.) | 1 ml |
| Distilled water | 805 ml |

(Preparation of Sub-coated Support)

On one (photosensitive layer) side of the corona-processed biaxially stretched PET support of 175 μm thickness described hereinabove, the sub-coating solution of formulation 1 was applied with a wire bar so as to give a wet coating amount of 6.6 ml/m$^2$, and dried at 180° C. for 5 min. Then, on the opposite (back) side, the sub-coating mixture of formulation 2 was applied with a wire bar so as to give a wet coating amount of 5.7 ml/m$^2$, and dried at 180° C. for 5 min. Further, the sub-coating solution of formulation 3 was applied on the backside of the support so as to give a wet coating amount of 7.7 ml/m$^2$, and dried at 180° C. for 6 min. Thus, the sub-coated support completed.

(Preparation of Back Coating Solution)

(Preparation of Fine Solid Dispersion of Base Precursor (a))

In 220 ml distilled water, 64 g of base precursor 11, 28 g of diphenylsulfone and 10 g of Demol N, a surfactant of Kao Corp. were mixed, and the resulting mixture was dispersed in a sand mill (a ¼ gallon sand grinder mill manufactured by Imex Co., Ltd.) with beads to prepare a fine solid dispersion of the base precursor (a) (average grain diameter: 0.2 μm).

Preparation of Fine Solid Dye Dispersion

With 305 ml distilled water, 9.6 g of cyanine dye 13 and 5.8 g of sodium p-dodecylbenzenesulfonate were mixed, and the resulting mixture was dispersed with a sand mill (a ¼ gallon sand grinder mill manufactured by Imex Co., Ltd.) with beads to prepare a fine dispersion of the solid dye (average grain diameter: 0.2 μm).

(Preparation of Coating Solution for Antihalation Layer)

A coating solution for an antihalation layer was prepared by mixing 17 g gelatin, 9.6 g polyacrylamide, 70 g of the above-described fine solid dispersion of the base precursor (a), 56 g of the above-described fine solid dye dispersion, 1.5 g of fine poly(methyl methacrylate) particle with an average particle size of 8 μm, 0.03 g benzoisothiazolinone, 2.2 g sodium polystyrenesulfonate and 0.2 g blue dye 14.

(Preparation of Coating Solution for Back Protective Layer)

In a vessel heated to 40° C. was prepared a coating mixture for the back protective layer by mixing the following ingredients.

| | |
|---|---|
| Gelatin | 50 g |
| Sodium polystyrenesulfonate | 0.2 g |
| N,N-ethylenebis (vinylsulfonacetamide) | 2.4 g |
| Sodium tert-octylphenoxyethyoxyethanesulfonate | 1 g |
| Benzoisothiazolinone | 30 mg |
| N-perfluorooctylsulfonyl-N-propylalanine potassium salt | 37 mg |
| Poly (ethylene glycol) mono (N-perfluorooctyl-sulfonyl-N-propyl-2-aminoethyl) ether (average polymerization degree of ethylene oxide: 15) | 0.15 g |
| $C_8F_{17}SO_3K$ | 32 mg |
| $C_8F_{17}SO_2N(C_3H_7)(CH_2CH_2O)_4(CH_2)_4$—$SO_3Na$ | 64 mg |
| Acrylic acid/ethyl acrylate copolymer (copolymerization weight ratio: 5/95) | 8.8 g |
| Aerozol OT (a product of American Cyanamide Co., Ltd.) | 0.6 g |
| Fluid paraffin emulsion (as fluid paraffin) | 1.8 g |
| Water | 950 ml |

<<Preparation of Silver Halide Emulsion 1>>

To 1421 ml distilled water, 3.1 ml of 1% by weight potassium bromide solution was added, and after further addition of 3.5 ml of 0.5 mol/l sulfuric acid and 31.7 g phthalated gelatin, the resulting mixture was charged in a reaction vessel made of stainless steel. To this mixture kept at 34° C. were added under stirring solution A prepared by adding 22.22 g silver nitrate in distilled water followed by dilution with distilled water to 95.4 ml, and solution B prepared by adding 15.9 g potassium bromide in distilled water followed by dilution with distilled water to 97.4 ml at a constant flow rate in 45 sec. Then, 10 ml of 3.5% by weight aqueous hydrogen peroxide solution, and subsequently 10.8 ml of 10% by weight aqueous benzimidazole solution were added. Next, solution C prepared by adding 51.86 g silver nitrate in distilled water followed by dilution with distilled water to 317.5 ml and solution D prepared by adding 45.8 g potassium bromide in distilled water followed by dilution with distilled water to 400 ml were added whereby solution C was added in 20 min at a constant flow rate, and solution D was added by controlled double-jet method under pAg maintained at 8.1. $K_3Ir(III)Cl_6$ was added in an amount of $1\times10^{-4}$ mole per mole silver ten minutes after the start of the addition of solutions C and D. Further, 5 seconds after the completion of the addition of solution C, $K_4Fe(II)(CN)_6$ aqueous solution was added in an amount of $3\times10^{-4}$ mole per mole silver. After the pH of the mixture was adjusted to 3.8 with 0.5 mol/l sulfuric acid, the agitation was stopped. The mixture was subjected to sedimentation, desalting and washing operations. The pH was adjusted to 5.9 with use of 1 mol/l NaOH to give rise to a silver halide dispersion with a pAg of 8.0.

To the silver halide dispersion obtained in the above-described manner and kept at 38° C., 5 ml of 0.34% by weight methanol solution of 1,2-benzoisothiazoline-3-one was added under stirring, and 40 minutes later a methanol solution of spectral sensitizing dye A was added in an amount of $1\times10^{-3}$ mole per mole silver. One minute after the completion of the dye addition, -the dispersion was heated to 47° C. A methanol solution of sodium benzenethiosulfonate was added in an amount of $7.6\times10^{-5}$ mole per mole silver 20 minutes after the temperature elevation, and after an interval of 5 minutes a methanol solution of tellurium sensitizer B was added in an amount of $1.9\times10^{-4}$ mole per mole silver. The resulting dispersion was ripened for 91 minutes. Then, 0.8% by weight methanol solution of N,N'-dihydroxy-N"-diethylmelamine was added by 1.3 ml. After 4 minutes interval, 5-methyl-2-mercaptobenzimidazole and 1-phenyl-2-heptyl-5-mercapto-1,3,4-triazole were added both in the form of methanol solution in amounts of $3.7\times10^{-3}$ mole and $4.9\times10^{-3}$ mole per mole silver, respectively. The resulting product is named silver halide emulsion 1.

The silver halide grains in emulsion 1 consisted of pure silver bromide having an average equivalent sphere diameter of 0.046 μm with a coefficient of variation of 20% for equivalent sphere diameter. The grain size, etc. were obtained by averaging 1000 grains recorded with an electron microscope. The ratio of [100] plane of these grains was determined to be 80% by the Kubelka-Munk method.

<<Preparation of Silver Halide Emulsion 2>>

The operations conducted in the grain formation for silver halide emulsion 1 were performed to prepare silver halide emulsion 2 with the following modifications; the liquid temperature during grain formation was changed from 34° C. to 49° C., the addition period of solution C was expanded to 30 minutes, and $K_3Fe(CN)_6$ was omitted. As in the case of silver halide emulsion 1, sedimentation, desalting, washing and dispersion operations were conducted. Further, the same spectral and chemical sensitizations were conducted as in emulsion 1 except that sensitizing dye A was used by $7.5\times10^{-4}$ mole per mole silver, that tellurium sensitizer B was used by $1.1\times10^{-4}$ mole per mole silver, and that 1-phenyl-2-heptyl-5-mercapto-1,3,4-triazole was used by $3.3\times10^{-3}$ mole per mole silver whereby the addition of 5-methyl-2-mercaptobenzimidazole and 1-phenyl-2-heptyl-5-mercapto-1,3,4-triazole were performed in the same manner as in emulsion 1. The emulsion grains in the resulting silver halide emulsion 2 were pure silver bromide cubic grains having an average equivalent sphere diameter of 0.080 μm with a coefficient of variation of 20% for equivalent sphere diameter.

<<Preparation of Silver Halide Emulsion 3>>

Silver halide emulsion 3 was prepared by following the grain formation operations for silver halide emulsion 1 except that the liquid temperature during grain formation was changed from 34° C. to 27° C. The sedimentation, desalting, washing and dispersion operations in the preparation of emulsion 1 were precisely performed. The spectral and chemical sensitizations for emulsion 1 were conducted except that the solid dispersion (in aqueous gelatin solution) of sensitizing dye A was added by $6\times10^{-3}$ mole per mole silver, and that tellurium sensitizer B was added by $5.2\times10^{-4}$ mole per mole silver. The emulsion grains in the resulting silver halide emulsion 3 were pure silver bromide cubic grains having an average equivalent sphere diameter of 0.038 μm with a coefficient of variation of 20% for equivalent sphere diameter.

<<Preparation of Mixed Emulsion A for Use in Coating Solution>>

The three emulsions 1, 2 and 3 described above were mixed in mixing ratios of 70:15:15 by weight, and to the dissolved mixture 1% by weight aqueous solution of benzothiazolium iodide was added in an amount of $7\times10^{-3}$ mole per mole silver.

<<Preparation of Scaly Fatty Acid Silver Salt>>

A sodium behenate solution was obtained by agitating the mixture of 87.6 kg behenic acid (Product name: Edenor C22-85R, manufactured by Henkel AG), 423 liter distilled water, 49.2 liter of 5 mol/l NaOH aqueous solution and 120 liter tert-butanol at 75° C. for one hour to react with one another. Separately, an $AgNO_3$ aqueous solution of 206.2 liter containing 40.4 kg $AgNO_3$ (pH=4.0) was prepared and kept at 10° C. Into a reaction vessel charged with 635 liter distilled water and 30 liter tert-butanol kept at 30° C., the above sodium behenate solution and $AgNO_3$ aqueous solution were added at a constant flow rate. The former required 62 min 10 sec and the latter 60 min for total addition, respectively. In the operation, the addition of the $AgNO_3$ aqueous solution preceded by 7 min 20 sec, then the addition of the sodium behenate solution started. Accordingly, after the completion of the $AgNO_3$ solution addition, there was a period of 9 min 30 sec during which only the sodium behenate solution was added. During the addition operation, the temperature in the reaction vessel was externally controlled so as to keep 30° C. Further, the pipeline supplying the sodium behenate solution was heat-retented by means of steam tracing, and the steam aperture was regulated so as to keep the temperature of an outlet of a tip of an addition nozzle at 75° C. Further, a pipeline supplying the aqueous solution of silver nitrate was insulted by circulating cool water in the outer space of a double pipe. The positions where the sodium behenate solution and the $AgNO_3$ aqueous solution were injected were symmetrical relative to the center of the agitator axis, and the vertical positions of the nozzles were controlled not to contact the reaction liquid.

After completion of the addition of the sodium behenate solution, the content of the vessel was left for 20 min under stirring at the same temperature, and then cooled to 25° C. Then, the solid ingredients were separated by centrifugal filtration, and the solid matter was washed with water until the filtrate showed an electric conductivity of 50 μS/cm. The fatty acid silver salt thus obtained was stored in the form of wet cake without further drying.

The shape of the silver behenate particles was examined with electron micrographs; the particles consisted of scaly crystals with A=0.14 μm, B=0.4 μm and C=0.6 μm on average, an average aspect ratio of 5.2, and an average equivalent sphere diameter of 0.52 μm with a coefficient of variation of 15% for equivalent sphere diameter. As for the definition of A, B and C, refer to the description of this specification.

To a piece of the wet cake containing 100 g dried solid matter, 7.4 g poly(vinyl alcohol) (Product name: PVA-217 of Kuraray Co., Ltd.) and water were added to make the total amount of 385 g. Then, the mixture was subjected to preliminarily dispersion with a homogenizer.

The preliminarily dispersed mixture was dispersed three times with a disperser (Trade name: Micro Fluidizer M-110S-EH of Microfluidex International Corp. A G10Z interaction chamber was used.) whereby the pressure of the disperser was adjusted to 171.5 MPa to obtain a silver behenate dispersion. The temperature of the mixture was kept at 18° C. during dispersion by arranging coiled heat exchanger ahead and in the back of the interaction chamber and controlling the temperature of the coolant.

<<Preparation of Fine Solid Dispersion of Reducing Agent>>

A slurry was prepared by adding and thoroughly blending 16 kg water to a mixture consisting of 10 kg of 1,1-bis(2-hydroxy-3,5-dimethylphenyl)-3,5,5-trimethyl-hexane as a reducing agent and 10 kg of 20% by weight aqueous solution of modified poly(vinyl alcohol) (Poval MP203 of Kuraray Co., Ltd.). By using a diaphragm pump, this slurry was sent to a horizontal sand mill (UVM-2 of Imex Co., Ltd.) charged with zirconia beads with an average diameter of 0.5 mm where the slurry was subjected to dispersion for 3 hr 30 min. Subsequently, 0.2 g of benzoisothiazolinone sodium salt was added together with water in such an amount as to make the concentration of the reducing agent 25% by weight. The resulting fine solid dispersion of the reducing agent proved to contain reducing agent particles having a median diameter of 0.42 μm and the largest particle diameter not exceeding 2.0 μm. The dispersion was filtered through a polypropylene filter with a pore size of 10.0 μm to eliminate foreign matter including dust, and then stored.

<<Preparation of Phosphoryl Compound Dispersion>>

A slurry was prepared by adding and thoroughly mixing 1.6 kg water to a mixture consisting of 1 kg triphenylphosphine oxide as a phosphoryl compound and 1 kg of 20% by weight aqueous solution of modified poly(vinyl alcohol) (Poval MP203 of Kuraray Co., Ltd.). By using a diaphragm pump, this slurry was sent to a horizontal sand mill (UVM-2 of Imex Co., Ltd.) charged with zirconia beads with an average diameter of 0.5 mm where the slurry was subjected to dispersion for 3 hr 30 min. Subsequently, 0.2 g of benzoisothiazolinone sodium salt was added together with water in such an amount as to make the concentration of the phosphoryl compound 25% by weight. The resulting fine solid dispersion of the phosphoryl compound proved to contain phosphoryl compound particles having a median diameter of 0.45 μm and the largest particle diameter not exceeding 2.0 μm. The dispersion was filtered through a polypropylene filter with a pore size of 10.0 μm to eliminate foreign matter including dust, and then stored.

<<Preparation of 10% by Weight Dispersion of Mercapto Compound>>

A slurry was prepared by adding and thoroughly mixing 8.3 kg water to a mixture consisting of 5 kg 1-phenyl-2-heptyl-5-mercapto-1,3,4-triazole and 5 kg of 20% by weight aqueous solution of modified poly(vinyl alcohol) (Poval MP203 of Kuraray Co., Ltd.). By using a diaphragm pump, this slurry was sent to a horizontal sand mill (UVM-2 of Imex Co., Ltd.) charged with zirconia beads with an average diameter of 0.5 mm where the slurry was subjected to dispersion for 6 hr. Subsequently, water was added in such an amount as to make the concentration of the mercapto compound 10% by weight. The resulting fine dispersion of the mercapto compound proved to contain mercapto compound particles having a median diameter of 0.40 μm and the largest particle diameter not exceeding 2.0 μm. The mercapto compound dispersion was filtered through a polypropylene filter with a pore size of 10.0 μm to eliminate foreign matter including dust and then stored. The dispersion was again filtered through a polypropylene filter with a pore size of 10 μm just before use.

<<Preparation of 20% by Weight Dispersion-1 of Organic Polyhalogen Compound>>

A slurry was prepared by adding and thoroughly mixing 10 kg water with 5 kg tribromomethyl-naphthylsulfone, 2.5 kg of 20% by weight aqueous solution of modified poly (vinyl alcohol) (Poval MP203 of Kuraray Co.), and 213 g of 20% by weight aqueous solution of sodium triisopropyl-naphthalenesulfonate. By using a diaphragm pump, this slurry was sent to a horizontal sand mill (UVM-2 of Imex Co., Ltd.) charged with zirconia beads with an average diameter of 0.5 mm where the slurry was subjected to dispersion for 5 hr. Subsequently, together with 0.2 g of benzoisothiazolinone sodium salt, water was added in such an amount as to make the concentration of the organic polyhalogen compound 20% by weight. The resulting fine dispersion of the polyhalogen compound proved to contain organic polyhalogen compound particles having a median diameter of 0.36 μm and the largest particle diameter not exceeding 2.0 μm. The organic polyhalogen compound dispersion was stored after filtered through a polypropylene filter with a pore size of 3.0 μm to eliminate foreign matter including dust.

<<Preparation of 25% by Weight Dispersion-2 of Organic Polyhalogen Compound>>

Instead of 5 kg tribromomethylnaphthylsulfone, the same amount of tribromomethyl(4-(2,4,6-trimethylphenyl-sulfonyl)phenyl)sulphone was used to prepare a 25% by weight dispersion of the organic polyhalogen compound via dispersion, dilution and filtration as in the preparation of 20% by weight dispersion-I of organic polyhalogen compound above. The resulting polyhalogen compound dispersion proved to contain polyhalogen compound particles having a median diameter of 0.38 μm and the largest particle diameter not exceeding 2.0 μm. This organic polyhalogen compound dispersion was stored after filtered through a polypropylene filter with a pore size of 3.0 μm to eliminate foreign matter including dust.

<<Preparation of 30% by Weight Dispersion-3 of Organic Polyhalogen Compound>>

Instead of 5 kg tribromomethylnaphthylsulfone, the same amount of tribromomethylphenylsulfone was used, and the amount of the 20% by weight MP203 aqueous solution was changed to 5 kg to prepare a 30% by weight dispersion of the organic polyhalogen compound via dispersion, dilution and filtration as in the preparation of 20% by weight dispersion-1 of organic polyhalogen compound above. The resulting polyhalogen compound dispersion proved to contain polyhalogen compound particles having a median diameter of 0.41 μm and the largest particle diameter not exceeding 2.0 μm. This organic polyhalogen compound dispersion was stored after filtered through a polypropylene filter with a pore size of 3.0 μm to eliminate foreign matter including dust. The dispersion was stored at a temperature below 10° C. until usage.

<<Preparation of 5% by Weight Solution of Phthalazine Compound>>

In 174.57 kg water, 8 kg modified PVA Poval MP203 of Kuraray Co., Ltd. was dissolved, and then, 3.15 kg of 20% by weight aqueous solution of sodium triisoporpylnaphthalenesulfonate and 14.28 kg of 70% by weight aqueous solution of 6-isopropylphthalazine were added to prepare 5% by weight 6-isopropylphthalazine solution.

<<Preparation of 20% by Weight Pigment Dispersion>>

To 64 g C. I. Pigment Blue 60 and 6.4 g Demol N of Kao Corp., 250 g water was added to make a slurry. In a vessel, the slurry was charged together with 800 g of zirconia beads having an average diameter of 0.5 mm, and dispersed for 25 hours in a disperser (1/4G sand grinder mill manufactured by Imex Co., Ltd.). The resulting pigment dispersion contained pigment particles having an average diameter of 0.21 μm.

<<Binder for Image-forming Layer>>

The SBR latex used as the binder for the image-forming layer was obtained as follows.

To polymer (P-1) described hereinabove, 1 mol/l NaOH and $NH_4OH$ were added so that the molar ratio of $Na^+$ ion:$NH_4^+$ ion be 1:2.3, and the pH was adjusted to 7.4. The latex concentration became 43% by weight.

The resulting latex had an average diameter of 0.1 μm a concentration of 43%, an ionic conductivity of 3.9 mS/cm (measured with a CM-30S conductivity meter manufactured by DKK-TOA Corp. at 25° C.), and an equilibrium water content of 0.6% by weight at 25° C., 60% RH measured by the method mentioned hereinabove.

<<Preparation of Coating Solution for Image-forming (Photosensitive) Layer>>

A coating solution for the image-forming layer was prepared by thoroughly mixing the following ingredients. The pigment dispersion prepared above

| | |
|---|---|
| (20 weight %) | 1.1 g |
| The organic silver salt dispersion | 103 g |
| PVA-205 (Kuraray Co. Ltd.) (20% aqueous solution) | 5 g |
| The reducing agent dispersion (25 weight %) prepared above | 25 g |
| The phosphoryl compound dispersion (25 weight %) | 9.4 g |
| Mixture of the organic polyhalogen compound dispersions 1, 2 and 3 in the weight ratio of 5:1:3 | 16.3 g |
| The mercapto compound dispersion (10 weight %) | 6.2 g |
| The pH-controlled polymer binder P-1 latex | 98.6 g |
| The phthalazine compound dispersion (5 weight %) | 18 ml |
| Silver halide emulsion A | 10 g |

The resulting mixture was sent to a coating die so as to give a coating amount of 70 ml/$m^2$ to perform coating.

The viscosity of the above coating solution was measured with a type B viscometer (a product of Tokyo Keiki Co., Ltd.) at 40° C. with a No. 1 roter at 60 rpm, giving 85 mpa·s.

On the other hand, the viscosity values measured with an RFS Fluid Spectrometer (Rheometic Science, Far East Ltd.) were 1500, 220, 70, 40 and 20 mPa·s for shear rate of 0.1, 1, 10, 100 and 1000 $sec^{-1}$, respectively.

The pH of the above coating solution was 7.0.

<<Preparation of Coating Solution for Interlayer in Image-forming Layer Side>>

A coating solution of the following ingredients for the formation of an interlayer provided on the image-forming layer side was prepared and supplied to a coating die so as to give a coating amount of 10 ml/$m^2$. Poly(vinyl alcohol) (PVA-205, a product of Kuraray Co., Ltd.)

| | |
|---|---|
| (10 weight % aqueous solution) | 772 g |
| The pigment dispersion (20 weight %) | 5.3 g |
| Latex of methyl methacrylate/-styrene/butyl acrylate/hydroxyethyl methacrylate/acrylic acid copolymer (copolymerization weight ratio: 64/9/20/5/2) (27.5 weight %) | 226 g |
| Aerosol OT (American Cyanamide Co., Ltd.) (5 weight % Aqueous solution) | 2 ml |
| Diammonium phthalate (20 weight % aqueous solution) | 10.5 ml |
| Water to make totally | 880 g |

The viscosity of the above coating solution measured with a type B viscometer (a product of Tokyo Keiki Co., Ltd.) at 40° C. with a No. 1 roter at 60 rpm was 21 mPa·s.

<<Preparation of Coating Solution for First Protective Layer in Image-forming Layer Side>>

A mixture of the following ingredients for the formation of a first protective layer provided on the image-forming layer side was prepared.

| | |
|---|---|
| Inert gelatin (dissolved in water) | 64 g |
| Latex of methyl methacrylate/-styrene/butyl acrylate/hydroxyethyl methacrylate/acrylic acid copolymer (copolymerization weight ratio: 64/9/20/5/2) (27.5 weight %) | 80 g |
| Phthalic acid (10% by weight methanol solution) | 23 ml |
| 4-Methylphthalic acid (10 weight % aqueous solution) | 23 ml |
| Sulfuric acid (0.5 mol/l) | 28 ml |
| Aerosol OT (American Cyanamide Co., Ltd.) (5 weight % aqueous solution) | 5 ml |
| Phenoxyethanol | 0.5 g |
| Benzoisothiazolinone | 0.1 g |
| Water to make | 750 g |

The above mixture was added with 26 ml of 4% by weight aqueous solution of chromium alum immediately before coating by means of a static mixer, and supplied to a coating die so as to give a coating amount of 18.6 ml/m$^2$. The viscosity of the above coating solution measured with a type B viscometer (a product of Tokyo Keiki Co., Ltd.) at 40° C. with a No. 1 roter at 60 rpm was 17 mpa·s.

<<Preparation of Coating Solution for Second Protective Layer in Image-forming Layer Side>>

A mixture of the following ingredients for the formation of a second protective layer provided on the image-forming layer side was prepared.

| | |
|---|---|
| Inert gelatin (dissolved in water) | 80 g |
| Latex of methyl methacrylate/-styrene/butyl acrylate/hydroxyethyl methacrylate/acrylic acid copolymer (copolymerization weight ratio: 64/9/20/5/2) (27.5 weight %) | 102 g |
| N-perfluorooctylsulfonyl-N-propylalanine potassium salt (5 weight % solution) | 3.2 ml |
| Poly (ethylene glycol) mono (N-perfluorooctyl-sulfonyl-N-propyl-2-aminoethyl) ether (average polymerization degree of ethylene oxide = 15) (2 weight % aqueous solution) | 32 ml |
| Aerosol OT (American Cyanamide Co., Ltd.) (5 weight % aqueous solution) | 23 ml |
| Finely divided poly(methyl methacrylate) (average diameter: 0.7 μm) | 4 g |
| Finely divided poly(methyl methacrylate) (average diameter: 4.5 μm) | 21 g |
| 4-Methylphthalic acid | 1.6 g |
| Phthalic acid | 4.8 g |
| Sulfuric acid (0.5 mol/l) | 44 ml |
| Benzisothiazolinone | 10 mg |
| Water to make | 650 g |

The above mixture was added with 445 ml of an aqueous solution containing 4% by weight of chromium alum and 0.67% by weight of phthalic acid immediately before coating by means of a static mixer, and supplied to a coating die so as to give a coating amount of 8.3 ml/m$^2$.

The viscosity of the above coating solution measured with a type B viscometer (a product of Tokyo Keiki Co., Ltd.) at 40° C. with a No. 1 roter at 60 rpm was 9 mPa·s.

<<Preparation of Photothermographic Material>>

On the backside of the subbed support described above, a coating solution for an antihalation layer and that for a back protective layer were simultaneously coated and dried to give an antihalation back layer. In the simultaneous multi-layer coating, the coating condition was controlled so as to give a coated amount of 0.04 g/m$^2$ of the finely divided solid dye for the antihalation layer, and a coated amount of 1.7 g/m$^2$ of gelatin for the back protective layer.

On the front side (opposite to the backside) of the support, an image-forming layer (the coated amount of silver halide: 0.14 g/m$^2$), an interlayer, first and second protective layers were coated in this order from the support by slide bead, simultaneous multi-coating to provide a photothermographic material sample No. 101.

The coating speed was 160 m/min with a 0.10 to 0.30 mm spacing between the leading edge of the coating die and the support surface; the pressure of the low pressure chamber was set 196–882 Pa lower than the atmospheric pressure. The support was exposed to ion flow to eliminate static charges prior to coating.

After passing the coating die, the coated solution was cooled in the adjacent chilling zone with an air flow having a dry bulb temperature of 10 to 20° C. Then, the coated film was transported in non-contact mode into a helical path, non-contact drying apparatus where the film was dried with a dry air having a dry bulb temperature of 23 to 45° C. and a wet bulb temperature of 15 to 21° C.

After drying, the film was equilibrated in an atmosphere of 25° C., 40–60% RH, and then heated so that the coated surface be 70 to 90° C. Finally, the coated surface was cooled to 25° C.

The matte degree of the thus finished photothermographic material was 550 sec for the image-forming layer side surface, and 130 sec for the back surface in terms of Bekk second.

Spectral sensitizing dye A

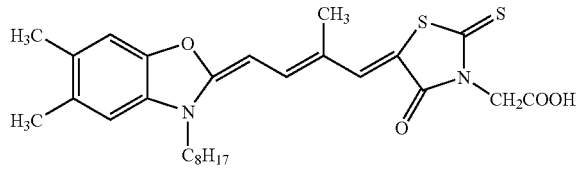

Tellurium sensitizer B

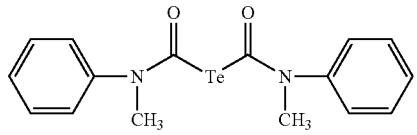

Base precursor 11

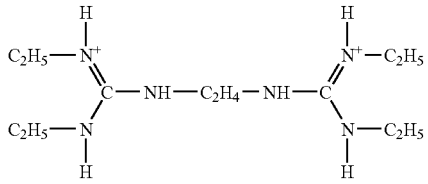

-continued

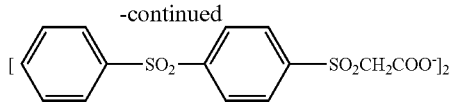

Cyanine dye 13

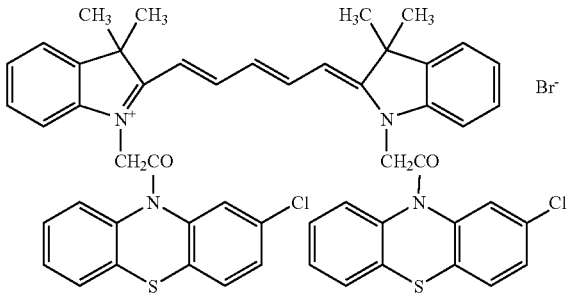

Blue dye 14

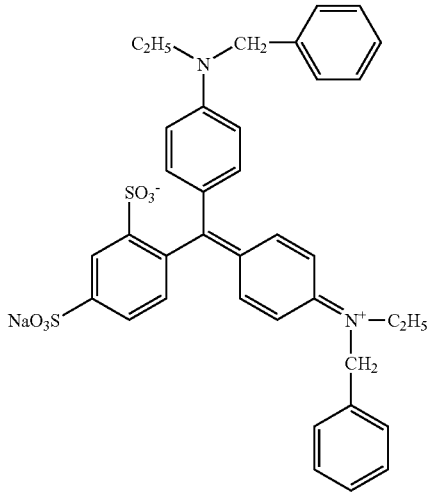

Comparative sample No. 100 was prepared in a similar manner as in the sample No. 101 prepared as described hereinabove except that the binder polymer for the image-forming layer was changed to the one shown in Table 1 (Binder polymer P-101 is described in JP-A-10-186565, comprising a latex of -$(St)_{50}$-$(Bu)_{42}$-$(AA)_8$- (St: styrene, Bu: butadiene, AA: acrylic acid) with a molecular weight of 36,000).

Further, sample Nos. 102 to 107 as examples of the invention were prepared according to the procedures described in the preparation of the sample No. 101 whereby only the polymer binder of the image-forming layer was changed as shown in Table 1.

(Evaluation of Coating Property)

By visually inspecting the surface condition of the coated samples, the number of defect per 5 $m^2$ such as streaks and spots was counted. The result is shown in Table 1 wherein A means 0 defect, B one, C 2 to 4 and D 5 or more. Only levels A and B are permitted for practical application.

(Evaluation of Storability)

A piece of each sample (Nos. 100–107) before image formation yet was kept in an atmosphere of 60° C., 50% RH for one day, then exposed imagewise and heat-developed (at about 120° C.) with a Fuji Medical Dry Laser Imager FM-DP L (equipped with a 660 nm semiconductor laser with the output power of 60 mW (IIIB)). The minimum density (Dmin) of the processed piece was measured. The storability was evaluated in terms of the increment of (Dmin) (ΔDmin) caused by the one day storage described above. The result is shown in Table 1.

TABLE 1

| Sample | Binder polymer | Fog increase (ΔDmin) | Coating property | Note |
|---|---|---|---|---|
| 100 | P-101 | 0.121 | D | Comparison |
| 101 | p-1 | 0.017 | B | This invention |
| 102 | P-2 | 0.022 | A | This invention |
| 103 | P-4 | 0.020 | A | This invention |
| 104 | P-5 | 0.028 | A | This invention |
| 105 | P-7 | 0.023 | A | This invention |
| 106 | P-11 | 0.039 | B | This invention |
| 107 | P-17 | 0.032 | A | This invention |

Table 1 clearly indicates that, by using the specific binder polymer characterizing the invention, a desirable coating property can be realized even with a low pH, and that the fog increase of the photosensitive material before image formation can be effectively suppressed, thus succeeding in providing a photosensitive material with an improved coating property as well as storability before image formation.

While the invention has been described in detail and with reference to specific embodiments thereof, it will be apparent to one skilled in the art that various changes and modifications can be made therein without departing from the spirit and scope thereof.

What is claimed is:

1. A method of producing a photothermographic image-recording material wherein said method comprises forming an image-forming layer on a support by coating a coating composition of an aqueous dispersion comprising a binder, said image-forming layer comprising at least one photo-insensitive organic silver salt, and a reducing agent for silver ion, wherein said binder comprises a polymer having a recurring unit which is at least one selected from the group consisting of (1-1)

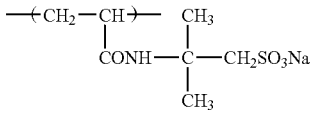

(1-2)

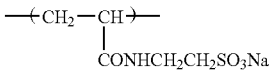

(1-3)

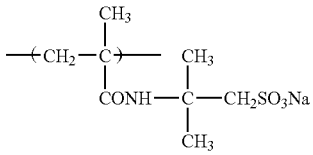

(1-4)

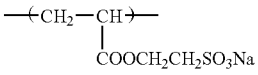

-continued
(1-5)
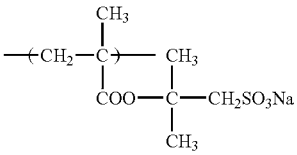
(1-6)
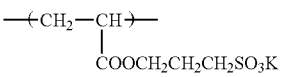
(1-7)
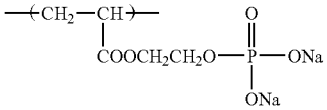
(1-8)
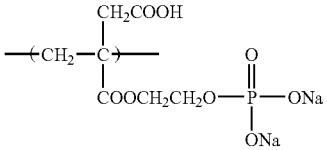
(1-9)
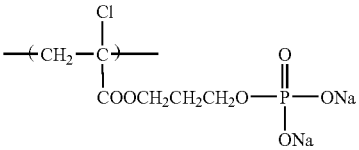
(1-10)
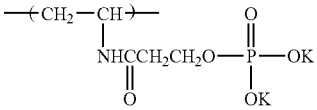
(1-11)
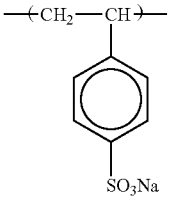
(1-12)
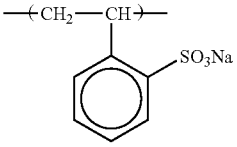
(1-13)
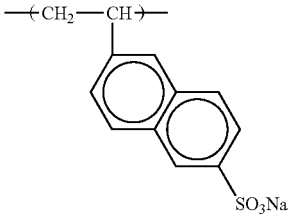
(1-14)
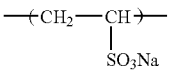
(1-15)
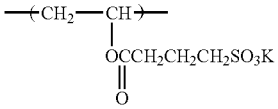
-continued
(1-16)
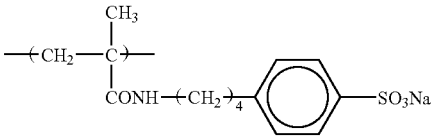
(1-17)
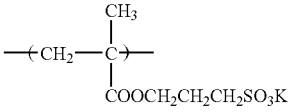
(1-18)
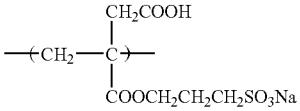
(1-19)
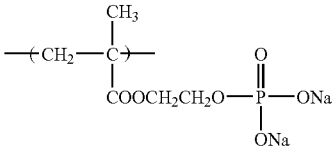
(1-20)
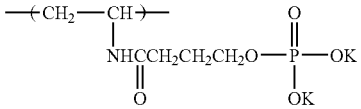
(1-21)
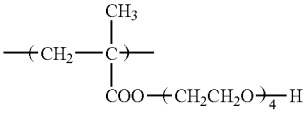
(1-22)
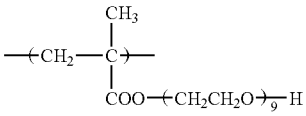
(1-23)
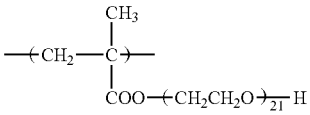
(1-24)
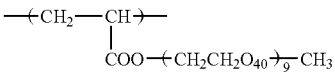
(1-25)
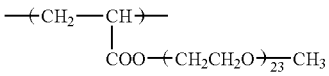
(1-26)
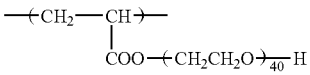
(1-27)
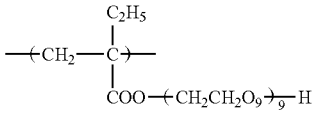
(1-28)
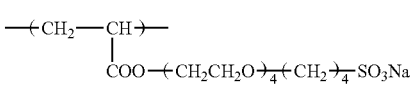

-continued (1-29)

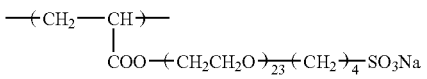

(1-30)

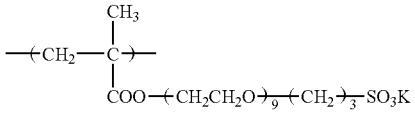

(1-31)

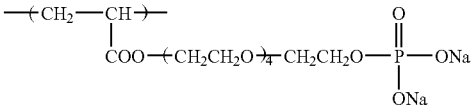

(1-32)

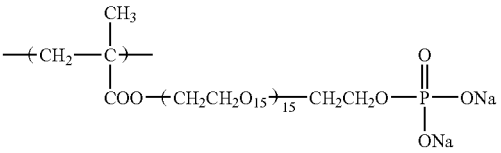

(1-33)

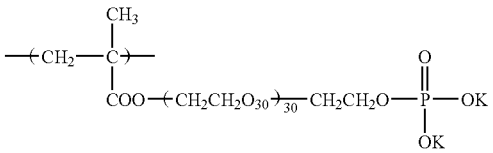

and (1-34)

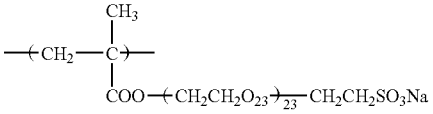

and wherein said binder is a latex produced by emulsion polymerization and wherein said coating composition has a pH of from 3.0 to 8.0, and said binder polymer has a glass transition temperature (Tg) ranging from 10 to 60° C.

2. The method according to claim 1, wherein said binder further comprises a copolymer comprising, in addition to the recurring unit, a conjugated diene or an α,β-unsaturated carboxylic acid derivative as a monomer.

3. The method according to claim 1, wherein said binder further comprises a copolymer comprising, in addition to the recurring unit, a conjugated diene as a monomer.

4. The method according to claim 1, wherein said image-forming layer comprises at least one photo-sensitive silver halide.

5. The method according to claim 1, wherein said recurring unit is at least one selected from the group consisting of (1-1), (1-2), (1-3), (1-4), (1-5), (1-6), (1-7), (1-8), (1-9), (1-16), (1-17), (1-18), (1-19), (1-21), (1-22), (1-23), (1-24), (1-25), (1-26), (1-27), (1-28), (1-29), (1-30), (1-31), (1-32), (1-33) and (1-34).

6. The method according to claim 1, wherein said recurring unit is at least one selected from the group consisting of (1-1), (1-2), (1-3), (1-4), (1-5), (1-6), (1-7), (1-8), (1-9), (1-10), (1-15), (1-17), (1-18), (1-19) and (120).

7. The method according to claim 1, wherein recurring unit is at least one selected from the group consisting of (1-21), (1-22), (1-23), (1-24), (1-25), (1-26), (1-27), (1-28), (1-29), (1-30) and (1-34).

8. The method according to claim 1, wherein the content of said recurring unit in said polymer is 0.2 to 30% by weight.

9. The method according to claim 1, wherein said binder further comprises a copolymer comprising, in addition to the recurring unit, an olefin, an α,β-unsaturated carboxylic acid, a salt of an α,β-unsaturated carboxylic acid, an amide of an α,β-unsaturated carboxylic acid, an unsaturated nitrile, styrene, a derivative of styrene, a vinyl ether or a vinyl ester as a monomer.

10. The method according to claim 4, wherein the amount of said photo-sensitive silver halide is 0.03 to 0.6 g/m$^2$ per 1 m$^2$ of the photosensitive material.

* * * * *